US008387843B2

(12) United States Patent
Kramer

(10) Patent No.: US 8,387,843 B2
(45) Date of Patent: Mar. 5, 2013

(54) DUAL POSITION BACKPACK

(76) Inventor: Robert F. Kramer, El Dorado Hills, CA (US)

( * ) Notice: Subject to any disclaimer, the term of this patent is extended or adjusted under 35 U.S.C. 154(b) by 293 days.

(21) Appl. No.: 12/660,778

(22) Filed: Mar. 3, 2010

(65) Prior Publication Data

US 2010/0230458 A1 Sep. 16, 2010

Related U.S. Application Data

(63) Continuation-in-part of application No. 11/020,723, filed on Dec. 23, 2004, now Pat. No. 7,681,769.

(51) Int. Cl.
*A45F 4/00* (2006.01)

(52) U.S. Cl. ..... 224/581; 224/631; 224/637

(58) Field of Classification Search ..... 224/647–650, 224/259, 581, 197, 600, 604, 631, 637; 190/108
See application file for complete search history.

(56) References Cited

U.S. PATENT DOCUMENTS 2,970,316 A * 2/1961 Silin ..... 2/94
4,428,514 A 1/1984 Elf
4,518,107 A 5/1985 Amos
5,337,934 A 8/1994 Johnson et al.
5,437,403 A 8/1995 Lemanski
5,657,917 A 8/1997 Johnson et al.
5,732,867 A 3/1998 Perkins et al.
5,799,851 A 9/1998 Wulf et al.
5,803,332 A 9/1998 Thompson
5,975,387 A 11/1999 Gleason et al.
6,010,051 A 1/2000 Callanan
6,098,859 A 8/2000 Bortner
6,164,505 A 12/2000 Holter et al.
6,179,175 B1 1/2001 Painter
6,179,188 B1 1/2001 Gleason
6,216,932 B1 4/2001 Wu
6,276,584 B1 8/2001 McLachlan
6,371,346 B1 4/2002 Sharma
6,402,003 B1 6/2002 Jackson
6,837,409 B2 * 1/2005 Lemanski, II ..... 224/579
2001/0052532 A1 * 12/2001 Perez et al. ..... 224/575

* cited by examiner

*Primary Examiner* — Justin Larson
*Assistant Examiner* — Corey Skurdal

(57) ABSTRACT

A backpack having a harness configured to be secured to the torso of a user, and a movable storage compartment pivotably connected at a first end to a first location on the harness. A second end of the storage compartment is releasably secured to a second location on the harness so that motion of the storage compartment with respect to the harness is restrained. The storage compartment is secured to the harness such that it can be released from a stowed position to a frontal location on the harness that is accessible to the user. With the second end of the storage compartment free from constraint, it can be pivoted about its first end from its stowed position to a frontal position on the user, wherein the frontal position allows access to articles contained in the storage compartment without removing the backpack from the user's body.

20 Claims, 20 Drawing Sheets

DUAL POSITION BACKPACK

CROSS-REFERENCE TO RELATED APPLICATIONS

This application is a continuation-in-part of copending application Ser. No. 11/020,723, filed on Dec. 23, 2004, herein incorporated by reference in its entirety.

BACKGROUND OF THE INVENTION

1. Field of the Invention

The present invention relates generally to methods and devices for carrying articles. More particularly, the invention is directed to devices and methods for carrying articles in a backpack wherein the articles can be accessed without removing the backpack from the wearer's body.

Backpacks have become increasingly popular over the years, especially for travel and recreational activities. Numerous variations of the backpack have been developed for carrying articles such as sporting, camping or hunting gear, clothing, books, food and drink, and other belongings. Backpacks are particularly convenient for activities such as walking, hiking, climbing, biking, camping, skiing, snowboarding, snowshoeing, mountaineering, rock-climbing, hunting, horseback-riding and the like because they free the hands of the user and transfer the load away from the hands, which are easily fatigued. Conventional packs are typically designed to be worn with the carrying compartment on the user's back, because carrying a pack on the front of the user restricts motion and limits the user's activities. Therefore, to gain access to articles contained in the pack, the user must first remove the pack, creating a number of inconveniences for almost any type of activity. Once the pack is removed, at least one hand is required to hold it, leaving only the other hand to open or unzip the pack, access the desired article contained therein, and then juggle the article to zip the pack back up or use the article. Alternatively, the pack must be placed on a stable surface such as a table or the ground to free up a hand to retrieve the article contained within.

For certain activities, the options for accessing objects within the pack are even more cumbersome. For example, skiers, snowboarders, backcountry hikers, etc. may have one or both hands already occupied by carrying ski poles and/or ski gloves or other equipment. Therefore, accessing, using, or consuming an item contained in the pack often requires the user to resort to setting the poles, gloves, and/or backpack down. The above practice is not only burdensome, but when done on a chair lift or on a steep slope, in deep powder or on a windy day, the user risks losing any or all of the set down items. Accordingly, numerous sunglasses, gloves, keys, and other items are lost as a result of the above predicament or lack of proper storage.

Conventional backpacks are also burdensome for skiers or snowboarders because they are not suitable for riding on chairlifts while being worn. When riding on a lift with a backpack, the contents of the pack are susceptible to being crushed against the chair's backrest as the wearer leans back. Additionally, if bulky or numerous items are stored in the pack, the wearer tends to lean forward in the seat, which is not only uncomfortable, but unsafe because it shifts the wearer's center of gravity forward toward the open edge of the chair.

Consequently, there has been a need for a backpack that enables a user access to articles contained therein without removing the pack from the user's body. U.S. Pat. No. 5,779,851 describes a combined day pack/travel pack that has a detachable day pack that may be worn on the front of the user in conjunction with a conventional travel pack on the user's back. While this design allows the user to access articles within the day pack, the pack is unsuitable for many sports activities as its continuous position in front of the wearers torso restricts the wearer's freedom of motion.

U.S. Pat. Nos. 5,337,934, and 5,657,917 attempt to address this problem by providing a carrying device having pouches that can be flipped from a stowed position on a main pack over the user's shoulders to a position at the front of the user. In the above patents, the pouch is retained in the rear position by hook and loop material. While the aforementioned patents disclose a device that does allow the user to access some of the contents of the backpack without removing the pack, the hook and loop material is inadequate for retaining the pouches in their stowed position during physical activity such as skiing or snowboarding, or for retaining larger compartments containing bulky or heavy articles. Because release of the hook-and loop material is facilitated by loading the opposing sections in opposite directions to cause separation, a hook-and-loop fastening is susceptible to unwanted release due to dynamic loading that naturally occurs during typical activity. Therefore, the aforementioned device is not suitable for physical activity, and is especially not suited to provide access to a large compartment carrying much or all of the backpack's contents.

Alternatively, U.S. Pat. No. 5,437,403 discloses a travel pack that slides around the user's body to allow the user to access articles contained therein. The pack has a compartment connected to two straps, the first strap shaped to circumscribe the waist of the user, and the second strap shaped to extend under the arm on one side of the user and over the shoulder of the opposite side of the user. The pack is moved from the back to the front of the user by sliding the compartment under the arm of the user. Because the compartment must slide between the user's side and arm, it is limited to in shape and size to that can comfortably pass through. Additionally, because the compartment is only held by one strap over the shoulder, it is not very stable for highly physical activity.

Additionally, there is a need for a backpack that allows attachment of large equipment such as a pair of skis or a snowboard without compressing the contents of the backpack. U.S. Pat. No. 5,803,332 is a typical backpack having straps for attaching and carrying large equipment. However, this pack requires that the equipment be strapped to the outside panel of the pack, which is generally less stable than the inner panel adjacent to the wearer's back, and also tends to crush any other articles that may be inside the pack.

In view of the foregoing, it would be desirable to provide a convertible backpack that enables a user to access articles contained in the backpack while the backpack is worn on the person. In particular, it would be desirable to provide a convertible backpack that enables a user to move a storage compartment from the user's back to a position at the front of the user without requiring that the backpack be removed or pulled off of the user. Moreover, it would also be desirable to provide a convertible backpack that enables a user to move a carrying compartment from the front of the user to a position on the back of the user and securely retain the compartment in the aft position during high impact activity without motion relative to the user. It would further be desirable to provide a convertible backpack that is capable of holding equipment such as a shovel, snowboard or pair of skis to a panel adjacent to the user's back and between the panel and a storage compartment having articles therein. At least some of these objectives will be met by the present invention.

2. Description of the Background Art

U.S. Pat. Nos. 5,337,934, 5,437,403, 5,657,917, 5,779,851, and 5,803,332 have been described above. Other patents of interest include U.S. Pat. Nos. 4,428,514, 4,518,107, 6,010,051, 6,179,175, 6,216,932, and 6,402,003.

BRIEF SUMMARY OF THE INVENTION

The present invention provides an improved apparatus for carrying articles in a backpack so that the articles may be accessed by the user without having to remove the pack from the body.

Although the following description will focus on embodiments configured for high activity sports such as skiing or snowboarding, other embodiments may be used to in a variety of applications. In particular, the carrying devices and methods of the present invention may be used whenever access to articles contained in the backpack pack is desired without having to remove the pack from the wearer's body. Therefore, the following description is provided for exemplary purposes and should not be construed to limit the scope of the invention.

In a first aspect of the present invention, a backpack comprises a harness having a waist belt and left and right shoulder straps that are attached at their ends to the waist belt such that they each form a loop, and a movable storage compartment pivotably connected at a first end to a first location on the harness, wherein a second end of the of the storage compartment is releasably secured to a second location on the harness so that motion of the storage compartment with respect to the harness is restrained. The storage compartment is secured to the harness such that it can be released from a frontal location on the harness that is accessible to the user. With the second end of the storage compartment free from constraint, it can be pivoted about its first end from its stowed position to a frontal position on the user, wherein the frontal position allows access to articles contained in the storage compartment without removing the backpack from the user's body.

In a preferred embodiment, the storage compartment comprises one or more openings so that articles located inside the storage compartment can be accessed from either the stowed or frontal position. The one or more openings may be enclosed by zippers, buttons, hook and loop material, etc. located at the front and/or the rear of the storage compartment.

In another preferred embodiment, the harness has a support panel having a back wall adjacent to the person's back, a front wall adjacent to the storage compartment when in the stowed position, an upper section attached to a first end of each of the left and right shoulder straps, and a lower section attached to a second end of the left and right shoulder straps, wherein the waist belt is affixed to the lower section of the support panel.

In many cases, the support panel has a stiffening means so that the back wall rigidly conforms to the contours of the user's back. The stiffening means may comprise a generally planar piece of semi-rigid material, such as a polymer, plastic, condensed foam, etc, that is interposed between the back and front walls of the support panel. Ideally, the stiffening means is rigid enough to provide stability to the harness, yet flexible enough to conform to the contours of the user's back. The support panel may also comprise padding on the back wall adjacent to the user's back so that heavy loads may be comfortably carried in the backpack. In some embodiments, the support panel also has a recess interposed between the front and back walls of the support panel to accommodate additional storage. For example, a recess may be sized to accommodate a hydration bladder between the front and back walls of the support panel.

In some cases, the backpack further comprises an anti-sliding means to inhibit lateral motion between the storage compartment and the harness. Often, the anti-sliding means comprises first and second sections of material having a high coefficients of friction, wherein the first section of material is positioned on the front wall of the support panel, and the second section of material is positioned on the back wall of the storage compartment so that it opposes the first section of material when the storage compartment is in the stowed position. The front wall of the support panel may also comprise one or more holding straps to carry an elongate article.

Typically, the storage compartment has a top section and a bottom section, and the top section of the storage compartment is pivotably connected to a location on the left and right shoulder straps, and the bottom section of the storage compartment is releasably fastened to the waist belt at a location accessible to the user while wearing the backpack. In some cases, the top section of the storage compartment has a recess between the connection on the left and right shoulder straps to provide clearance for the storage compartment as it is rotated from the stowed position to the frontal position on the user.

In an alternative embodiment, the storage compartment may further comprise left and right rotation straps, wherein the left rotation strap is connected at a first end to the top section of the storage compartment, and pivotally connected at a second end to the left shoulder strap, and the right rotation strap connected at a first end to the top section of the storage In some embodiments the storage compartment is releasably attached to the left and right shoulder straps so that it can be carried separately independent of the harness as a handbag. In cases where the rotation straps are used, the rotation straps may be releasably connected to the shoulder straps, the storage compartment, or both. The left and right shoulder straps may also comprise a plurality of attachment points for releasably attaching the storage compartment. For example, the plurality of attachment points comprise receiving slots for one or more loops. Optionally, the storage compartment may further comprise a latching member that releasably attaches to the one of the loops or slots on each shoulder strap.

In many embodiments, the backpack will have left and right support straps each fixed at a first end to opposite ends of the lower section of the storage compartment, and releasably fastened at a second end to the waist belt. In some embodiments, a quick release buckle releasably fastens the support strap to the waist belt. Alternatively, a ratchet assembly releasably fastens the support strap to the waist belt, the ratchet assembly comprising a serrated strap and a ratcheting buckle. As another alternative, a latch assembly may be used to releasably fasten the support strap to the waist belt, wherein the latch assembly comprises a tongue and latch having interlocking surfaces that can be released by depressing a lever arm on the latch.

In another aspect of the invention, the backpack further comprises a lower movable compartment and a sternum strap, wherein the lower storage compartment is fixed to the harness adjacent to and below the movable storage compartment. In this configuration the movable storage compartment may be pivotably connected at its top end to a location on the left and right shoulder straps, and releasably fastened to a second location on the left and right shoulder straps. The sternum strap may also be used in any of the embodiments of the invention to retain the shoulder straps from sliding outward on the person's shoulders.

In yet another aspect of the invention, a backpack comprises: a harness having a support panel, waist belt and left and right shoulder straps, wherein the support panel has a back wall adjacent to the user's back, a front wall spaced apart from the wearer's back, and a movable storage compartment having an inner wall and an outer wall. The storage compartment is pivotably connected at a first end to a first position on the harness, and a second end of the storage compartment is releasably fastened to a second position on the harness. When in a stowed position, the movable storage compartment is secured adjacent to the front wall of the harness, so that motion of the storage compartment with respect to the harness is restrained. The storage compartment is pivoted about its first end from the stowed position to a frontal position on the user to gain access to articles contained in the storage compartment. Additionally, one or more pieces of equipment may be mounted between the front wall of the harness and the inner wall of the storage compartment. For example, one or more holding straps may be attached to the outer wall of the support panel so that an elongate article may be fastened between the harness and the storage compartment.

In another embodiment of the invention, a method of fabricating a backpack having a compartment accessible from a front and back of a user comprises: pivotably connecting a first section of a storage compartment to a first position on a harness; and releasably fastening a second section of the of the storage compartment to a second position on the harness; wherein the storage compartment is secured to the harness in a stowed position so that motion of the storage compartment with respect to the harness is restrained, and wherein the storage compartment may be pivoted about its first end from its stowed position to a frontal position on the user so that articles contained in the storage compartment may be accessed without removing the backpack from the user's body.

In another embodiment of the invention, method of accessing articles in a backpack while the backpack is worn on a user, comprises: placing a backpack on a user, the backpack having a storage compartment and a harness, the harness having a waist belt and left and right shoulder straps; fastening the waist belt to the user; releasing a lower section of the storage compartment from a secure position on the harness, wherein the storage compartment is released at a location at the front of the harness that is accessible to the user; rotating the storage compartment from the stowed position at the back of the user over the shoulder straps to a frontal position on the user; and opening the storage compartment to gain access to the articles contained therein. The support panel typically has a back wall adjacent to the user's back, and a front wall spaced apart from the user's back, and may also comprise holding straps for carrying an elongate article on the front wall of the support panel.

In a further aspect, the first end of the movable compartment is located at an upper section of the movable compartment, and the second end of the movable compartment is located at a lower section of the movable compartment, and the first end of the movable compartment is pivotably connected via a pivotable connection at or near one of the left or right shoulder straps, and the second end of the movable compartment is releasably secured around at least a portion of the waist of the user at a location accessible to the user while wearing the backpack.

In one embodiment of the current aspect, the pivotable connection comprises a singular connection at or near one of the left or right shoulder straps, and the second end of the moveable compartment is releasably secured at a first releasable connection at a frontal location on the first arm of the waist belt, the first arm being opposite from the singular pivotable connection.

In another embodiment, the pivotable connection comprises a singular connection at or near one of the left or right shoulder straps, and second end of the moveable compartment is releasably secured around the waist of the user.

In a further embodiment, the second end of the moveable compartment is releasably secured at a second releasable connection at a frontal location on the second arm of the waist belt, and the first and second releasable connections are laterally spaced apart at a lower section of the harness.

In yet another embodiment, the moveable compartment, in a stowed configuration, has an upper extent that extends from the pivotable connection and diagonally downward from the pivotable connection across the harness to one of the first and second hip belt arms that are on the opposing side of the harness from the pivotable connection. In a preferred embodiment, the upper extent of the moveable compartment is crescent shaped to allow for clearance of the moveable compartment over the user's head while the moveable compartment is rotated to a frontal position.

In one embodiment, the pivotable connection is at or near a first shoulder of the user when the backpack is positioned on the body, wherein the harness extends, when the moveable compartment is in the stowed position on the user's body, diagonally across the torso of the user and under an opposing shoulder of the user to releasably connect on a frontal position on the waist belt.

In a further embodiment, the pack includes a fixed compartment extending from the harness and extending diagonally above the moveable compartment when the moveable compartment is in the stowed position, wherein the fixed compartment has a lower extent that substantially matches the profile of the upper extent of the moveable compartment.

Further aspects of the invention will be brought out in the following portions of the specification, wherein the detailed description is for the purpose of fully disclosing preferred embodiments of the invention without placing limitations thereon.

DETAILED DESCRIPTION OF THE INVENTION

In the following description, various aspects of the invention will be described. For purposes of explanation, specific configurations and details are set forth in order to provide a thorough understanding of the present invention. However, it will also be apparent to one skilled in the art that the present invention may be practiced without the specific details herein. Furthermore, well known features may be omitted or simplified in order not to obscure the present invention.

Embodiments of the present invention relate to apparatus and methods for carrying articles on the front or back of a user. The device comprises a backpack having a harness and a movable storage compartment that is able to pivot interchangeably from the back and front of the user.

Figure 1A:
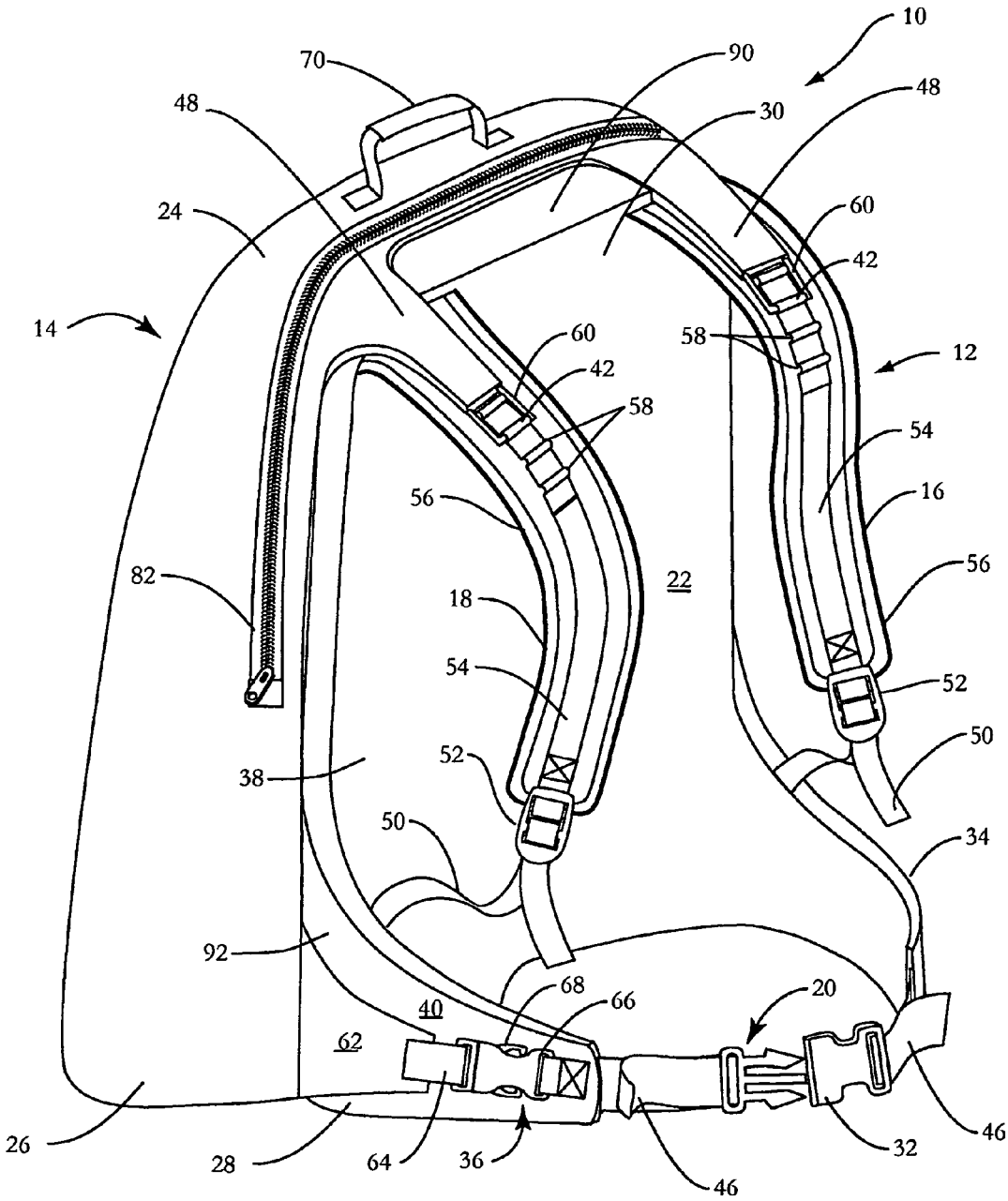
FIG. 1A is a perspective view of a backpack having a movable storage compartment in accordance with the present invention.

Reference is now made to FIG. 1A, which is a schematic illustration of the backpack 10 in accordance with the embodiments of the invention. The backpack 10 includes a harness 12, and a movable storage compartment 14 for carrying articles. The harness 12 has a left shoulder strap 16, right shoulder strap 18, support panel 22, and a hip or waist belt 20. The left shoulder strap 16 and right shoulder strap 18 are connected at their ends to the top section 30 and bottom section 28 of support panel 22. The left and right shoulder straps generally comprise padded shoulder sections 56 and shoulder webbing straps 50. The padded shoulder sections 56 each having mounting straps 54 sewn to the top surface and running along the length of the padded section 56. The left and right shoulder straps 16, 18 may further comprise strap-lock buckles 52, which connect one end of the mounting straps 54 with the shoulder webbing straps 50 so that the length of shoulder webbing straps 50 may be adjusted.

Figure 11:
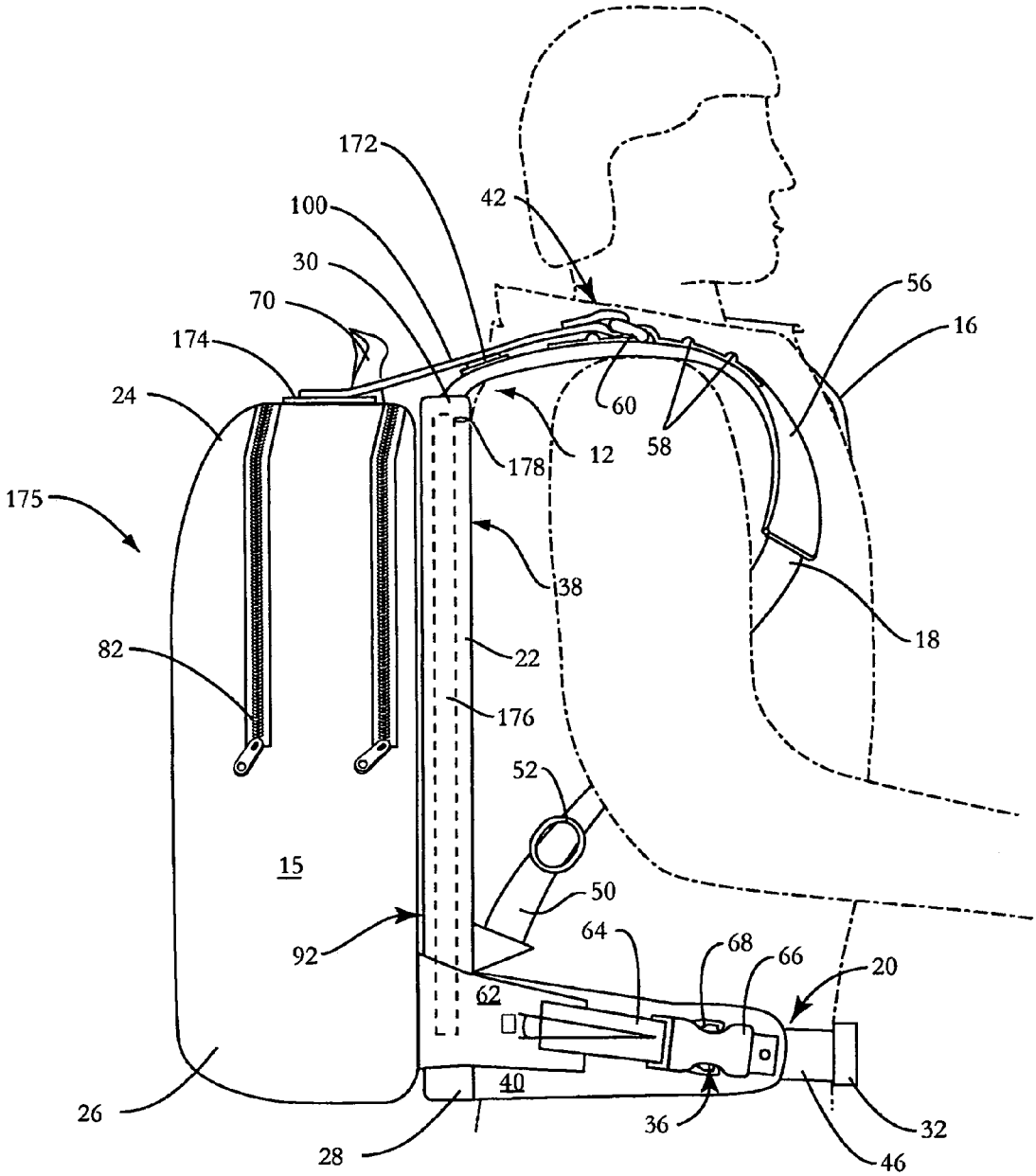
FIG. 11 is an alternative embodiment of the invention having rotation straps to connect the movable compartment to the harness.

Typically, the waist belt 20 is connected to opposite ends of the bottom section 28 of the support panel 22. The waist bet 20 generally comprises waist adjustment straps 46 and a quick-release buckle 32 for adjustably securing the bottom end of the backpack 10 around the users waist. Buckle 32 may include a variety of different fasteners known in the art, including a side release buckle, center release buckle, cam buckle or the like. Waist adjustment straps 46, webbing straps 50, and mounting straps 54 may comprise any flexible webbing material such as nylon, cotton, polyester or the like. The waist belt 20 also may have and left and right padded sections 34, 40 that extend from the back of the user to the side or front of the user when the user is wearing the backpack. Left and right padded sections 34, 40 may be continuous extensions of support panel 22, as shown in FIG. 1A, or a separate padded belt that is attached to the back wall 38 of support panel 22 as illustrated in FIG. 11.

In many embodiments, movable storage compartment 14 is pivotably connected at its upper section 24 to a top section 30 of the harness 12 by two pivotable connections 42. Pivotable connections 42 are preferably located on the top of the left and right shoulder straps 16, 18, but may also be placed on the top 30 of the support panel 22. The lower section 26 of the movable storage compartment 14 is releasably connected to one or more locations on the bottom section 28 of the harness 12. Releasable connection 36 is generally located at a frontal or side position on the waist belt 20, and preferably on the foremost sections of the left and right padded sections 34, 40. Movable storage compartment 14 further comprises at least one closeable opening 82, which allows access to the interior of the storage compartment. Closeable opening 82 preferably comprises a zipper, but may also comprise buttons, snaps, hook and loop material, or other closure means. The movable compartment 14 preferably comprises a high denier fabric such as nylon, but may also comprise any lightweight but strong and flexible material or fabric.

Figure 12:
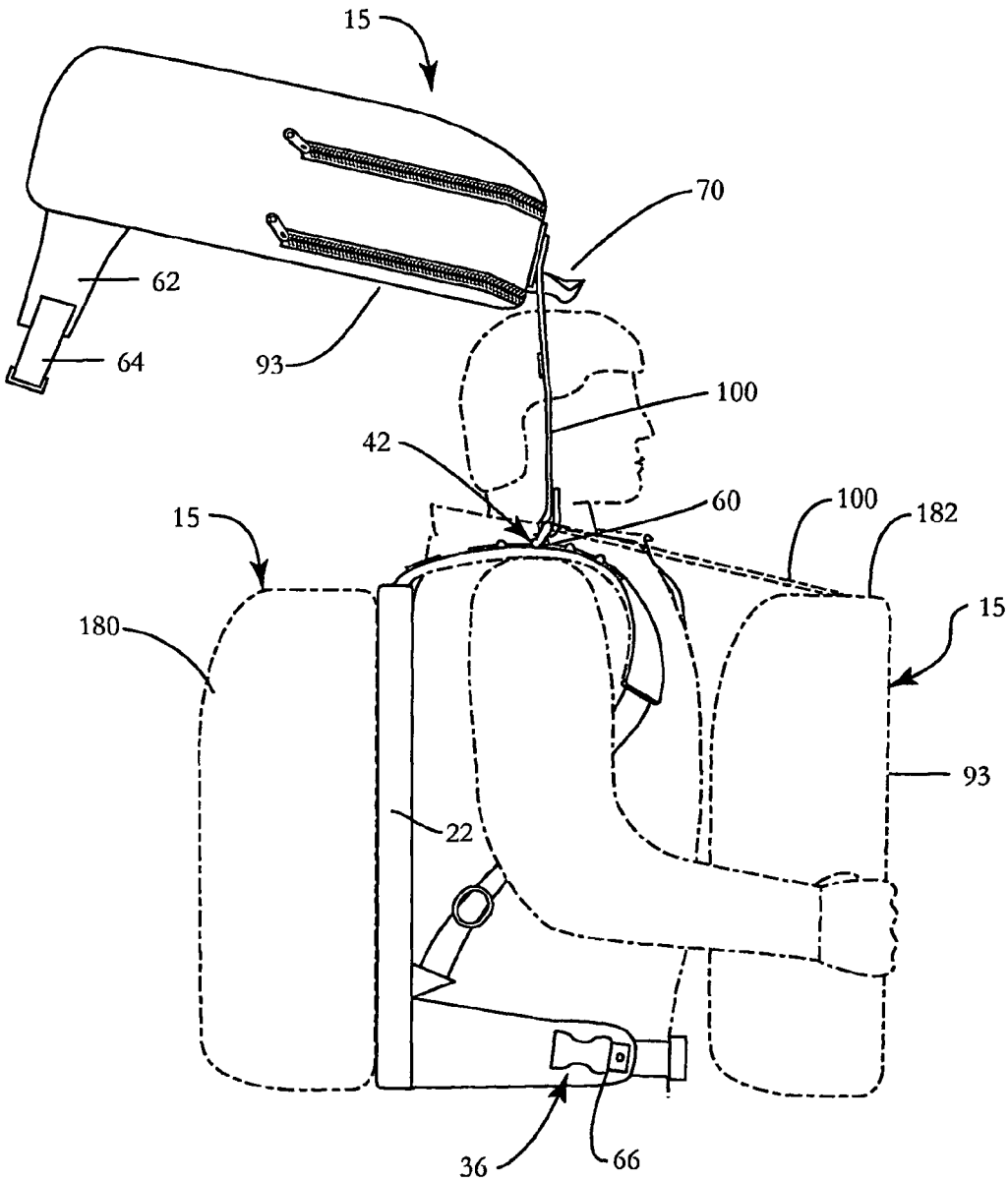
FIG. 12 illustrates an embodiment of the invention being rotate from the back of the user to the front of the user.

In one method of the present invention, the backpack 10 is secured to a user by fastening the waist belt to the user. The lower section 26 of the movable compartment 14 is released from the bottom section 28 of the harness 22 by disengaging releasable connection 36, which is accessible by hand from the front of the user. As seen in FIG. 12, the movable compartment 14 may then be rotated about pivotable connection 42 from the stowed position at the back of the user, over the shoulder straps 16, 18, to a frontal position on the user. To rotate the movable compartment, the user may pull up on compression strap 68, support strap 62, male connector 68, or a combination thereof to lift and rotate the movable compartment over the head of the user. Alternatively, the user can reach back and pull on handle 70 to rotate the movable compartment to the user's torso. Once positioned at the front of the user, the opening 82 of movable compartment 14 may then be opened to gain access to the articles contained therein.

Figure 1B:
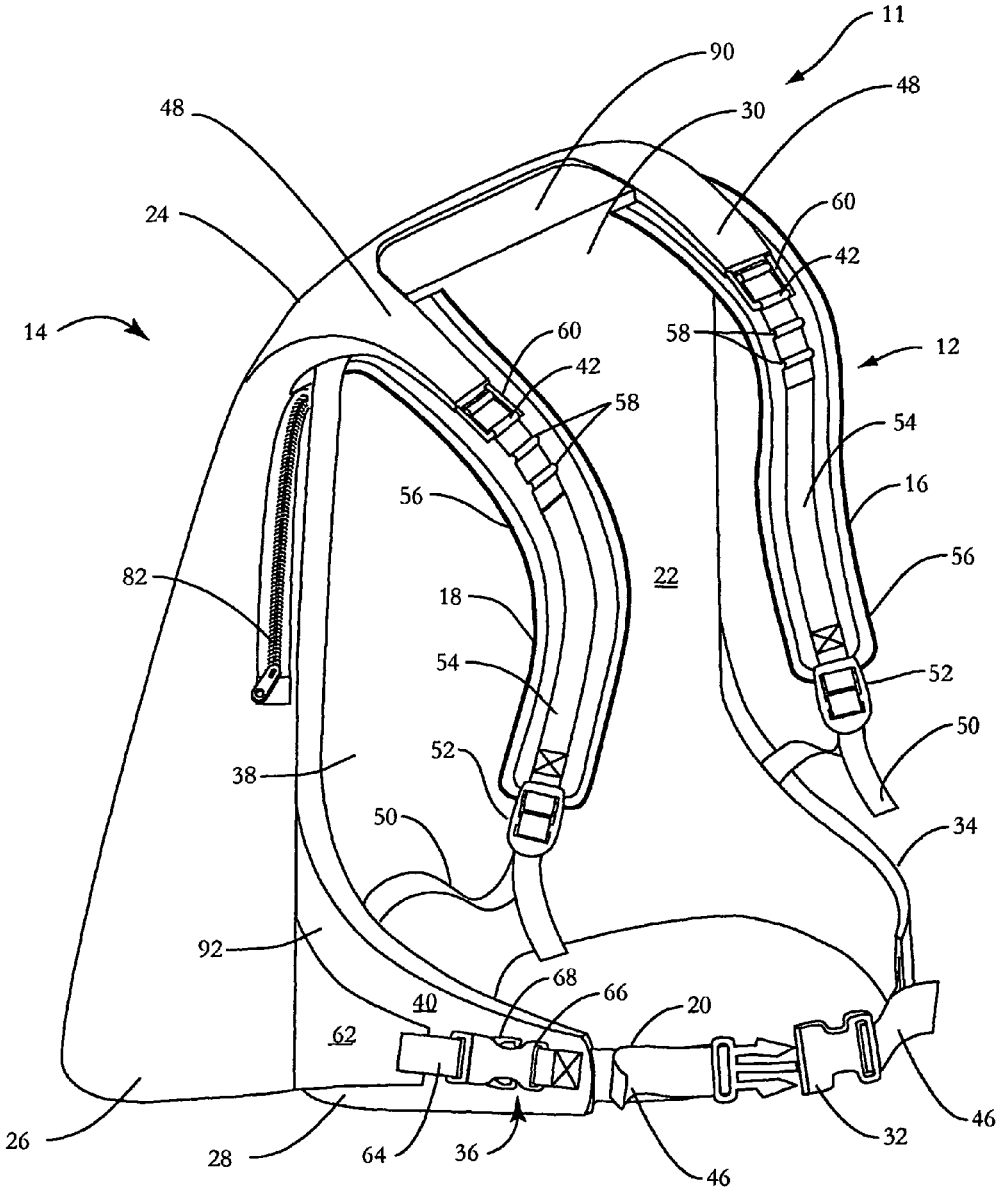
FIG. 1B is a perspective view of a backpack having a teardrop shaped movable storage compartment in accordance with the present invention.

Referring now to FIG. 1B, backpack 11 has a teardrop-shaped movable compartment 14 that tapers at the upper section 24. Zipper 82 crosses over to back wall 93 prior to the interface of u-shaped profile 48. In this configuration, the zipper 82 is in an outermost position when the movable compartment 14 is rotated to the front of the user, thereby allowing easy access to the user.

In many embodiments, the upper section 24 of movable compartment 14 may have a U-shaped profile 48 for pivotably connecting the movable compartment. The U-shape connection allows the main compartment clearance to pass over the head of the user as the compartment is rotated from the stowed to frontal position. Alternatively, the upper section 24 of the movable compartment may be pivotably connected to the shoulder straps 16, 18 by left and right rotation straps 100, as illustrated in FIGS. 11 and 12.

Referring now to FIGS. 6A to 7B, the pivotable connections 42 may comprise any rotatatable connection known in the art, for example: a hinge, bushing, ball bearing, roller bearing, thrust bearing or the like. In one embodiment, mounting straps 54 that are sewn into the top surface of shoulder straps 16, 18 so that one or more rotation housings 58 are positioned along the shoulder straps. Housings 58 are shaped to house a fastening loop 60. Fastening loop 60 may comprise a solid loop, caribiner, or an adjustable C-ring as shown in FIG. 7A and described in further detail below. Housings 58 may be sized to provide a snug fit with fastening loop 60 so that there is little or no play between the loop and the shoulder strap, but still allows rotation of the compartment about the shoulder strap. Little or no lateral or side-to-side motion between the harness 22 and the movable compartment 14 not only stabilizes the compartment during movement, but also allows for repeatable alignment of the lower section 26 of compartment 14 with releasable connection 36.

Figure 6A:
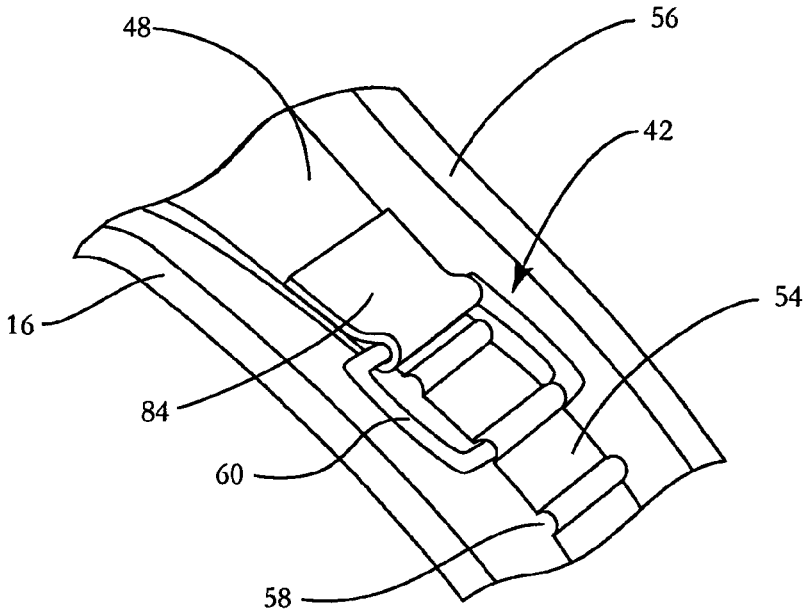
FIG. 6A illustrates a perspective view of a pivotable connection using a loop in accordance with the present invention
Figure 6B:
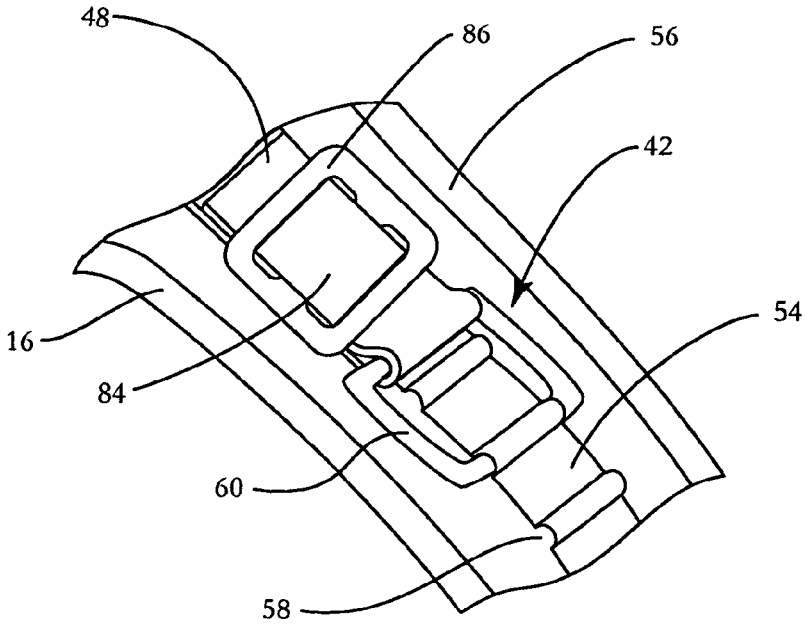
FIG. 6B is another embodiment of a pivotable connection using a loop and slider in accordance with the present invention.

Referring to FIG. 6A, fastening loop 60 comprises a rectangular loop housed at one end inside bearing 58 and connected at another end to end section 84 of profile 48. End section 84 may comprise a flexible material such as nylon fabric or webbing that is wrapped around the free side of loop 60 and is fastened back on to itself to encase the free side of loop 60. In such a case, end section may be fastened to itself by stitching, opposing pieces of hook-and loop material, rivets, buttons, snaps or the like. Loop 60 may also be combined with slider 86 such that slider 86 cinches down the two sides of end section 84 on to encase the loop 60, as illustrated in FIG. 6B. The fabric or webbing material of end section 84 may also have a stiffening member (not shown) that is flexible in one direction (bending), but is rigid in torsion and lateral directions so that the movable compartment 14 maintains alignment with releasable connection 36. Where mounting strap 54 is permanently fixed or sewn into padded shoulder section 56, multiple loops 60 may be encased into bushings 58.

Alternatively, end section 48 may comprise a semi-rigid material, such as plastic or a thin sheet of metal that is permanently folded over on to itself to provide a housing for loop 60. In this configuration, the end section material is flexible enough to allow the loop to be snapped into place, yet resilient enough to return to its folded-over configuration and retain the loop 60 in its housing.

Figure 7A:
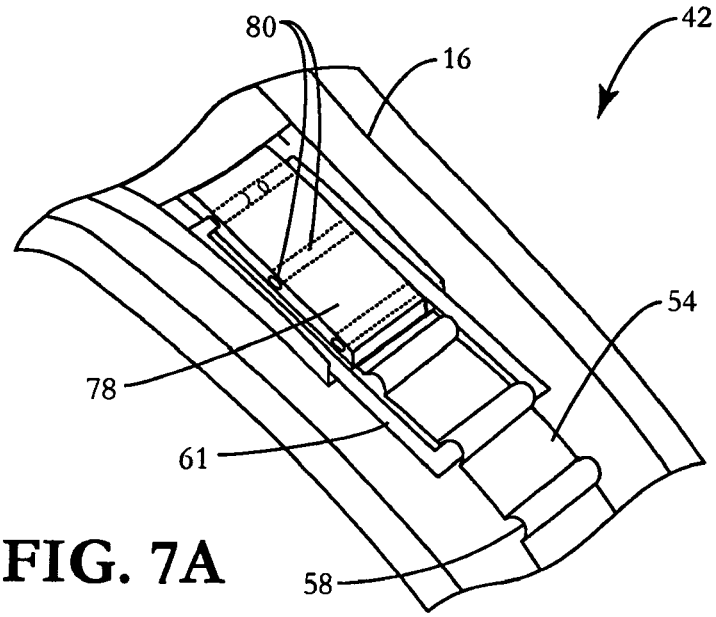
FIG. 7A illustrates another embodiment of a pivotable connection using a c-ring in accordance with the present invention.

Referring to FIG. 7A, fastening loop 61 comprises a C-ring that allows for adjustment of the length of U-shaped profile 48 to vary the clearance provided by the U-shaped profile. Where multiple bearings 58 are provided, the fastening loop 60 may be reinserted into a particular bearing 58 along the shoulder strap to compensate for the increased or decreased profile 48 and maintain the position of the main compartment with respect to the harness support panel. Each flange of the U-profile 48 may comprise a slotted insert 78 having a plurality of peg-holes 80 for adjustably fastening the C-ring to the movable compartment.

Figure 7B:
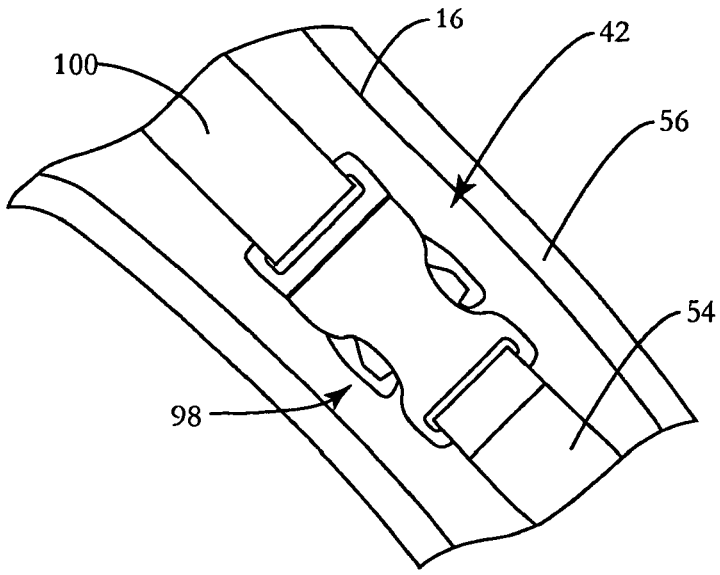
FIG. 7B shows yet another embodiment of a pivotable connection using a side-release buckle in accordance with the present invention.

In another embodiment shown in FIG. 7B, pivotable connection may comprise a quick release buckle 98 fastened at one end to mounting strap 54 and at a second end to rotation strap 100 or end section 84 (not shown). Mounting strap 54 is preferable fixed or sewn to padded shoulder section 56 up to the buckle 98 to limit lateral motion of buckle 98. This configuration allows for quick and full detachment of the movable compartment 14 from the harness 22. Alternatively, for a permanent pivotable connection 42, the buckle may be forgone and the rotation strap 100 may be integral with or sewn to the mounting strap 54 that is sewn into the shoulder strap.

Figure 7C:
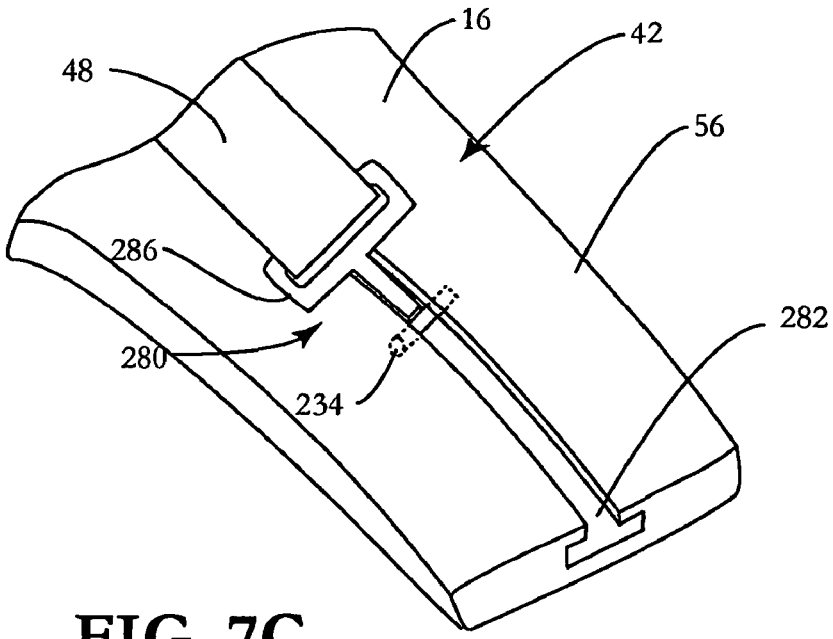
FIG. 7C shows yet another embodiment of a pivotable connection that is configured to slideably translate along the shoulder straps.
Figure 7D:
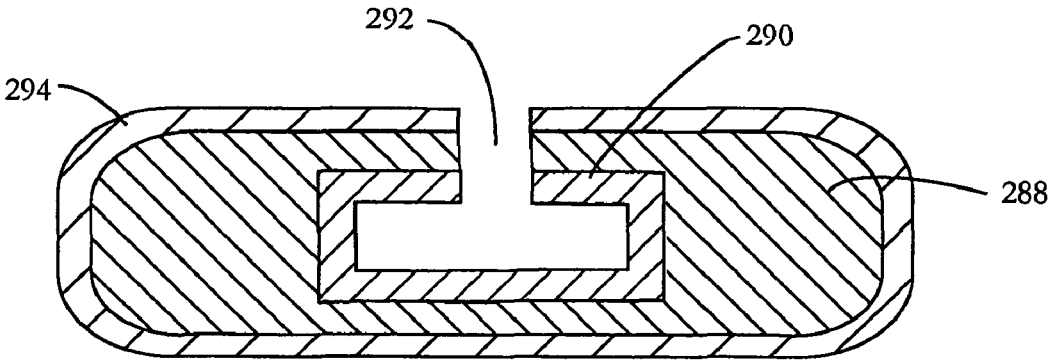
FIG. 7D shows a cross section view of the embodiment of FIG. 7*c*.

Now referring to FIG. 7C, pivotable connection 42 may also be configured to translate along the shoulder straps 16,18 to allow for additional clearance when rotating the movable compartment from the stowed orientation. Pivotable connection 42 may comprise a T-shaped connector 280 having a loop 286 for securing rotation strap 100 or profile 48. Connector 280 has a T-shaped engagement arm 284 sized to interface with c-shaped grove 282 that is embedded into and runs along the shoulder strap. As seen in a cross-section of the shoulder strap 16 in FIG. 7D, channel 282 may be formed by channel member 290 having a C-shaped cross section. Channel member 290 preferably comprises an extruded, flexible material, such as plastic, and is surrounded by padding 288 except at the upper extremity to leave a slot 292 so that the connector 280 is free to translate down the shoulder strap. The shoulder strap may further comprise nylon cover 294 the is sewn or glued to padding 288. In this configuration, pivotable connection 42 is allowed to translate from a location near the back of the user, to a location more forward, thus giving more clearance for the movable compartment as it is rotated over the user's head.

Figure 2:
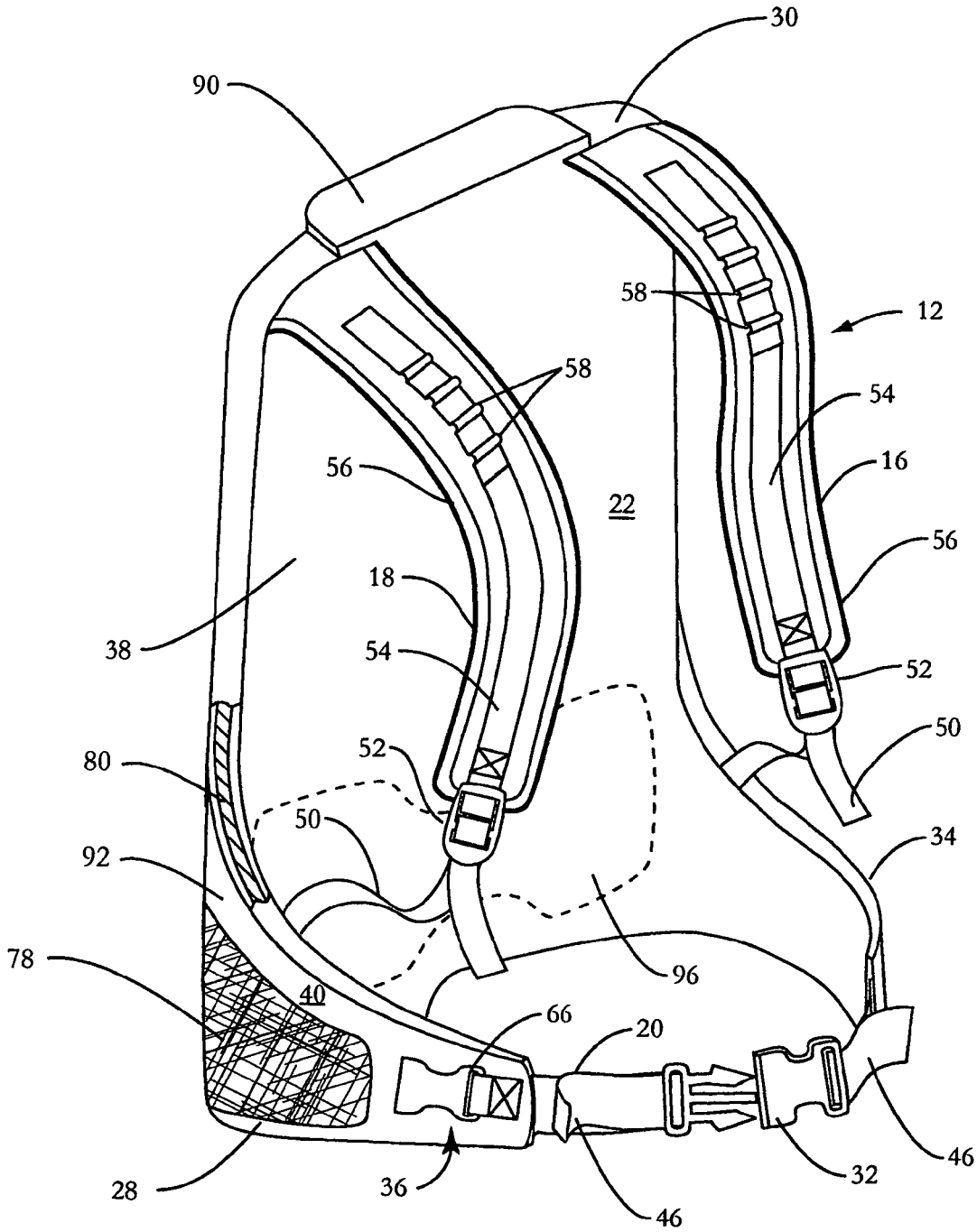
FIG. 2 is a perspective view of an exemplary harness for a backpack of the present invention.
Figure 3:
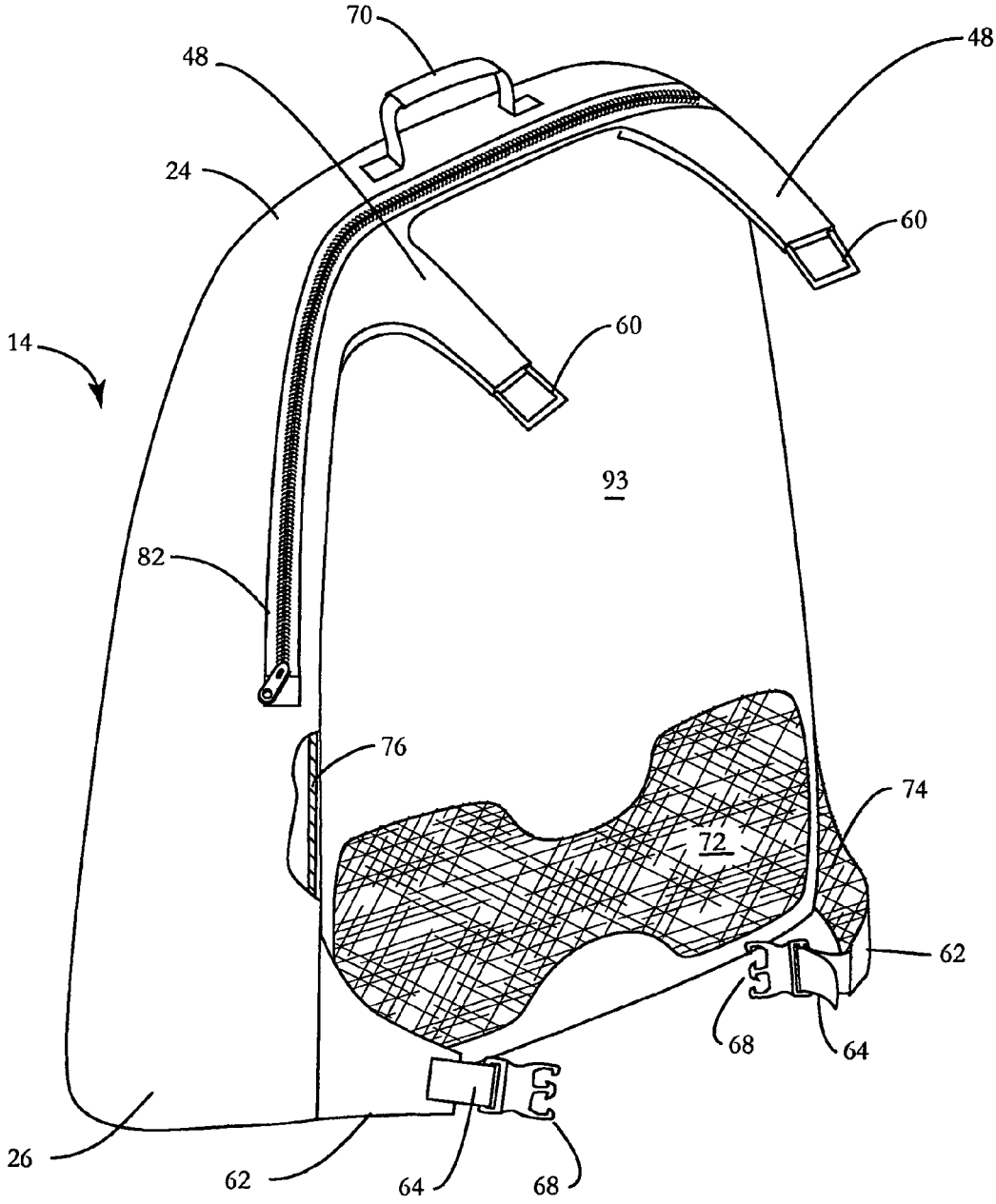
FIG. 3 is a perspective view of an exemplary movable storage compartment for a backpack of the present invention.
Figure 5:
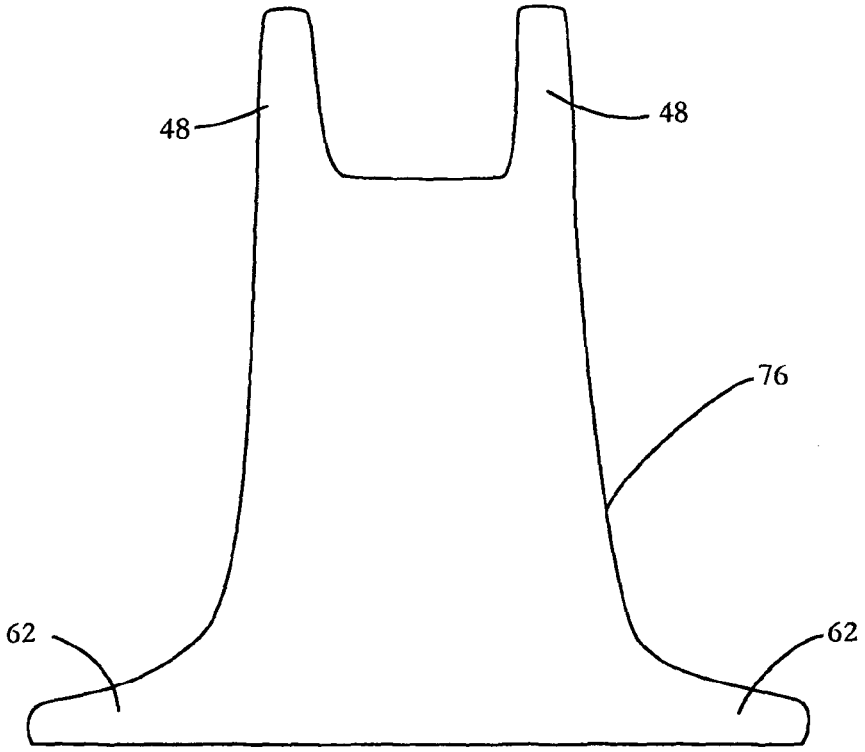
FIG. 5 is a rear view of a stiffening panel for a movable storage compartment in accordance with the present invention

In some embodiments, the movable compartment 14 and support panel 22 may have stiffening means such as compacted foam or a plastic stiffening panel 76 or 80 to keep the movable compartment and support panel from buckling or unduly bending. The stiffening means may comprise a generally planar piece of semi-rigid material, such as a polymer, plastic, condensed foam, etc, that is interposed between the back and front walls of the support panel. Ideally, the stiffening means is rigid enough to provide stability to the harness, yet flexible enough to conform to the contours of the user's back. The support panel may also comprise padding on the back wall adjacent to the user's back so that heavy loads may be comfortably carried in the backpack. As shown in FIG. 2, stiffening panel 80 may be disposed between the back wall 38 and the front wall 92 of the support panel and extend to hip pads 40 and 34. Movable compartment stiffening panel 76 may be disposed behind back wall 93, as shown in FIG. 3. The stiffening panel 76 may comprise a single sheet of material and extend to form the U-shaped section 48 and support straps 62, as illustrated in FIG. 5.

Figure 4:
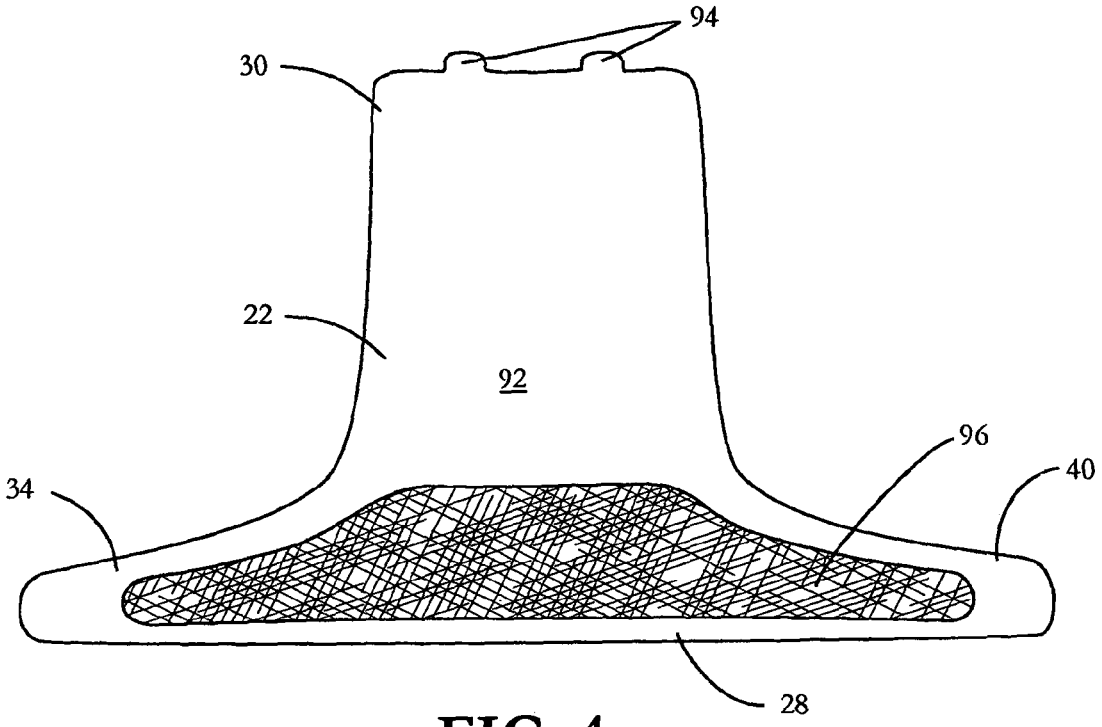
FIG. 4 is a rear view of a support panel of the harness in accordance with the present invention.

Referring to FIGS. 2-4, the front wall 92 of support panel 22 and the back wall 93 of the movable compartment may have mating motion inhibitor patches 96 and 72 having a high coefficient of friction to retain the movable compartment from laterally sliding in relation to the harness. Motion inhibiting material 74 and 78 may also be located on the hip belt pads 40, 34 and mating surfaces on support straps 62. Alternatively, motion inhibiting patch 96 may extend across the bottom end of the support panel across to the hip belt pads 34, 40, as illustrated in FIG. 4.

Figure 13:
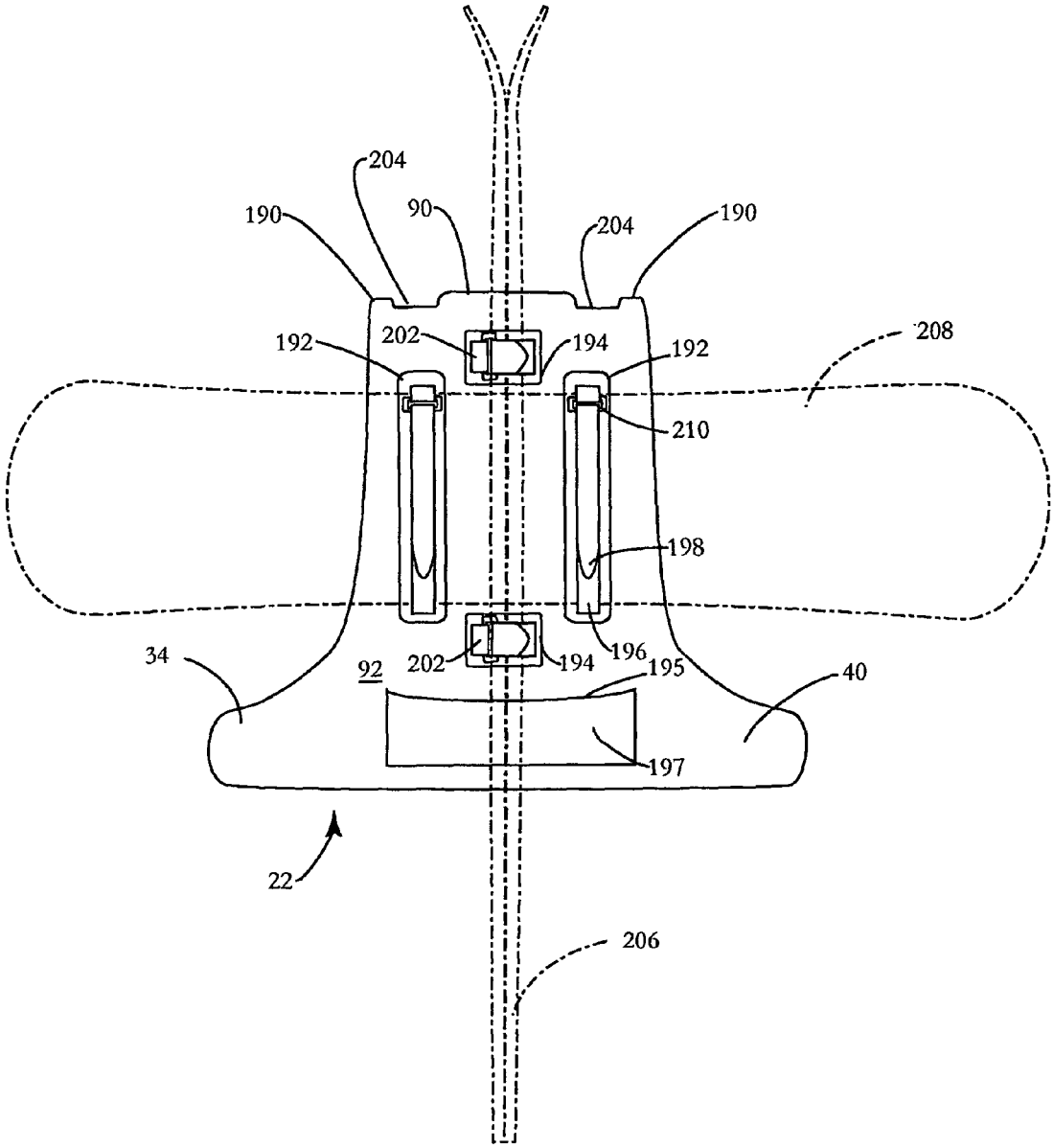
FIG. 13 shows another embodiment of the invention wherein the front wall of the harness panel has mounting straps for securing large or additional equipment.

To retain the top section of the movable compartment 14 from lateral movement with respect to the harness 12, the top section 30 of the support panel may have a raised tab 90, as shown in FIG. 2. Alternatively, the top section 30 may have a set of raised tabs 94, as shown in FIG. 4, or tabs 190 and recesses 204 as shown in FIG. 13.

Referring again to FIG. 1A, releasable connection 36 may comprise a quick release buckle having a male connector 68 and female connector 66 attached to the lower end 26 of the movable compartment 14. Releasable connection 36 may further comprise support strap 62 and adjustable compression strap 64 sewn around the loop of male connector 68 so that the movable storage compartment may be tightly secured to the harness 22. Female connector 66 is may be secured to the padded section 34, 40 of waist belt 20 in a variety of ways, including stitching, bolts, rivets, or the like. Support strap 62 preferably comprises a stiffening element to so that the male connector 68 lines up with the female connector 66 when they are not connected. Releasable connection 36 may comprise a variety of buckles known in the art, such as a side release buckle, center release buckle, can buckle etc.

In many cases, the user will be wearing gloves while fastening or unfastening releasable connection 36. Therefore, it is preferable that the release mechanism be relatively accessible to gloved hands. For example, a side kick release buckle (not shown) may be used to provide additional leverage to releasing the buckle. Other exemplary buckles designed for gloved release are found in U.S. Pat. Nos. 6,678,925, 6,487,761, and 5,832,573, the entire disclosures of which are incorporated herein by reference.

Because loading, varying user anatomy, and differing types of activity may change the orientation of the movable compartment 14 with respect to the harness 22, releasable connection may be coupled with adjustment or tightening means such as compression strap 64. Typically, compression strap 64 comprises adjustable webbing commonly used in the art. A stiffening means, such as that described for the pivotable connection above, may be incorporated with the adjustable webbing of compression strap 64 to maintain alignment with the connection points of the harness 22 and movable compartment 14.

Figure 8A:
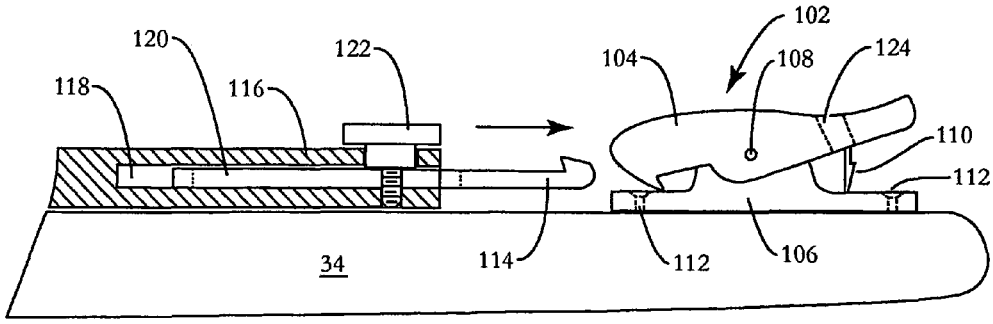
FIG. 8A illustrates a top view of a releasable connection using a tongue and latch in accordance with the present invention.
Figure 8B:
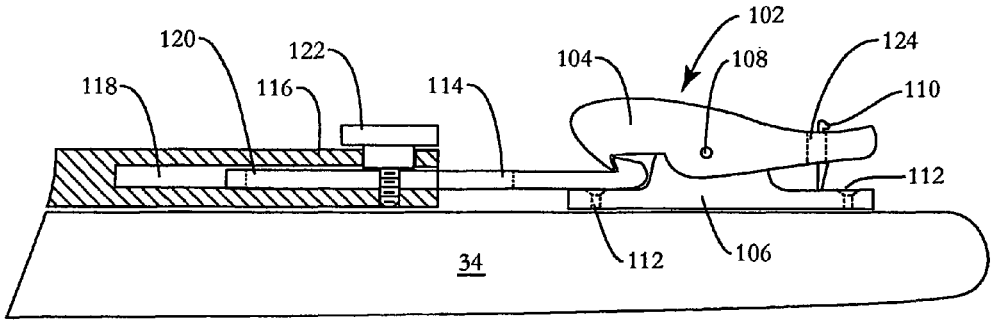
FIG. 8B is an illustration of the releasable connection of FIG. 8*a* in a locked configuration in accordance with the present invention.
Figure 8C:
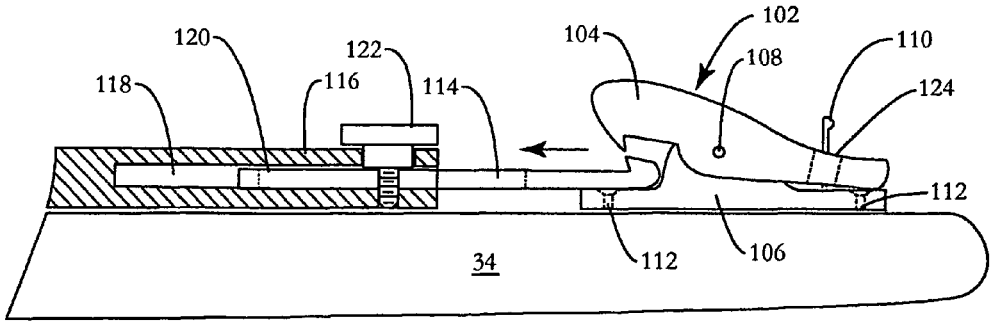
FIG. 8C is an illustration of the releasable connection of FIG. 8*a* in an open configuration in accordance with the present invention.

In one embodiment illustrated in FIGS. 8A-C, the releasable connection comprises a tongue and latch assembly 102. Latch assembly comprises a hook-shaped lever arm 104 pivotably mounted to a base 106 at hinge 108. Base 106 is secured to the outside surface of padded sections 34, 40 of the waist belt 20 by fastener 112. Fastener 112 may comprise a rivet, bolt or other fastener known in the art.

Tongue 114 has a mating hook-like surface to match that of the lever arm 104, and is adjustably mounted to the movable compartment 14 via sleeve 116. Sleeve 116 may attach to the movable compartment 14 at either the lower section 108, flap 62 or stiffening panel 76. Sleeve 116 has a channel 118 sized to receive tongue 114 at different lengths along slot 120 to function as a compression or tightening means to allow the tightening of the movable compartment 14 to the harness. When the desired placement of tongue 114 out of sleeve 116 is found, the tongue 114 is securely tightened to sleeve 116 by tightening screw 122. Tightening screw 122 may comprise a shoulder screw, or other screw known in the art that has a large head to allow for tightening and un-tightening by hand. As an alternative to the channel/screw compression means described above, a number of tightening means may be employed, such as compression strap 64 shown in FIG. 1, or tongue 114 could be configured to have a serrated surface instead of slot 120 to accommodate a ratchet buckle (such as ratchet buckle 150 shown below in FIG. 9C) attached to sleeve 116 to allow for tightening of the movable compartment to the harness.

To engage tongue 114 with latch 102, tongue 114 is forced in between the lever arm and base 106 until the two mating surfaces catch as shown in FIG. 8B. Hinge 108 may also be loaded with a compression spring or torsion spring (not shown) so that the latching portion of lever arm 104 presses against the tongue 114 when engaged, or base 102 when not engaged. Other latch-type devices such as draw latches or buckles may be used, or those described in U.S. Pat. Nos. 6,347,436 and 5,526,555, incorporated herein by reference.

Figure 9A:
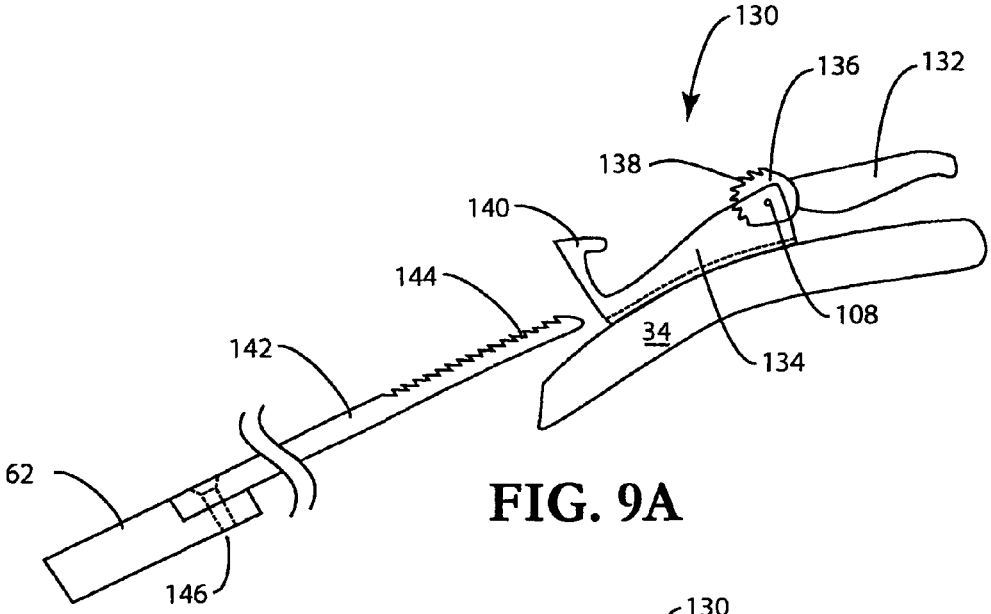
FIG. 9A illustrates a top view of a releasable connection using a ratchet cam assembly in accordance with the present invention.
Figure 9B:
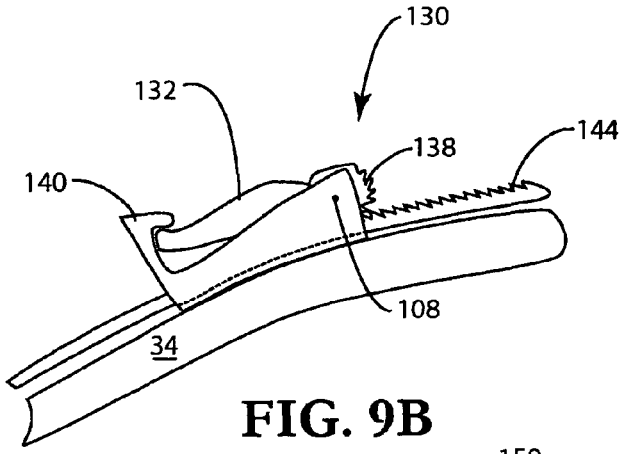
FIG. 9B is an illustration of the releasable connection of FIG. 9*a* in a locked configuration in accordance with the present invention.

Alternatively, releasable connection 36 may comprise a ratcheting cam buckle 130 and serrated strap 142, as illustrated in FIG. 9A-9B. Serrated strap 142 may attach to the movable compartment 14 at either the lower section 108, support strap 62 or stiffening panel 76. Shown in an open position in FIG. 9A, cam lever arm 132 is pivotably attached at hinge 108 to base 134, which is secured to the outer surface of padded sections 34, 40 of waist belt 20. Lever arm 132 has a pawl 136 having pawl teeth 138 and is spaced from the bottom of the base such that when serrated strap teeth 144 of tongue 142 engage the pawl teeth 138 when the tongue is inserted into the base. Lever arm 132 may then be rotated toward retainer 140, thereby advancing the serrated strap and support strap 62 to tighten compartment 14 to the harness. Retainer 140 is preferably flexible to allow lever arm to snap under the ledge of retainer 140 when pressure is applied on the lever arm 132 down on the retainer 140, as shown in a locked position in FIG. 9C. To release, lever arm 132 can be pulled away from lever arm 132, allowing the serrated strap to release from the pawl 136 of the lever arm. Support strap 62 may further comprise adjustment and compression means as shown in FIGS. 8A-C.

Figure 9C:
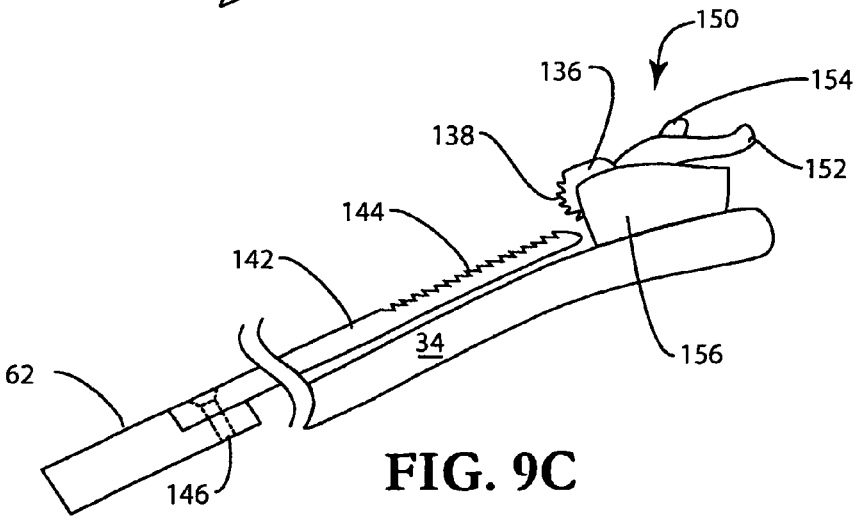
FIG. 9C illustrates a top view of a releasable connection using a ratchet buckle in accordance with the present invention.

Alternatively, releasable connection 36 may comprise a ratchet buckle assembly 150 and serrated strap 144, as illustrated in FIG. 9C. Ratchet buckle assembly 150 may comprise any ratchet buckle, as used for snowboard binding straps commonly known in the art, such as U.S. Pat. Nos. 5,745,959 and 5,416,952, incorporated herein by reference. Serrated strap 144 may be sewn or riveted to support strap 62. Ratchet buckle is fastened to padded section of waist belt 20. The ratchet assembly 150 allows for tightening of the movable storage compartment to the harness panel 22 by ratcheting the serrated strap 144 into the ratchet buckle by pulling on lever 152. To unlock the serrated strap 144 from the ratchet buckle 150, release lever 154 is pulled back to disengage pawl 136 from the teeth of the serrated strap. This configuration has the benefit of a flexibly rigid and adjustable attachment so that the serrated strap 144 repeatedly lines up with the ratchet buckle 150, while still allowing for adjustment/tightening means so that the movable compartment can be tightened securely to the harness. Preferably, flap 62 and back wall of movable compartment have integral stiffening means that provide a semi-rigid flexibility in bending and high rigidity in tension so that the ratchet can be buckled to a high tensile load without damaging the flap or the movable compartment.

Figure 10A:
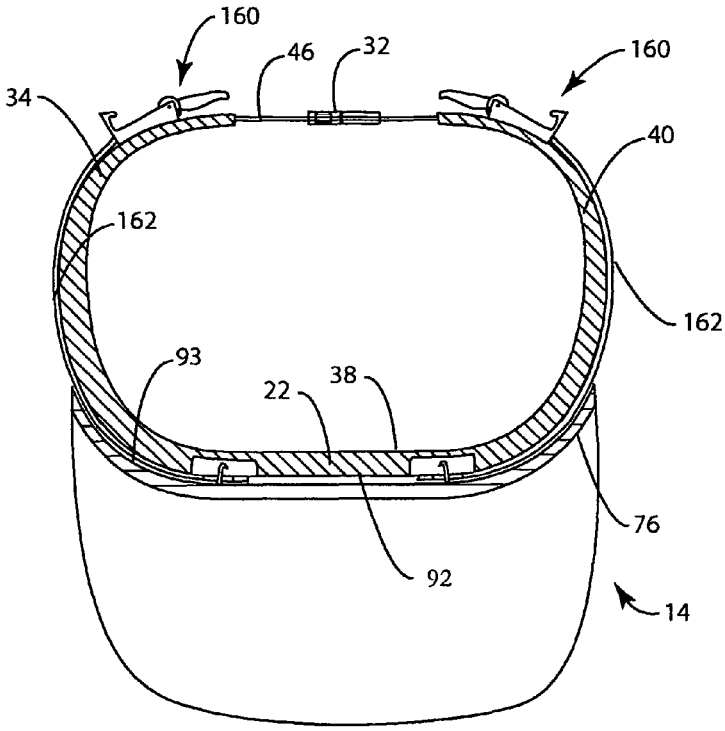
FIG. 10A is a cross-sectional view of a backpack of the present invention having a releasable connection using a cam-actuated compression strap.
Figure 10B:
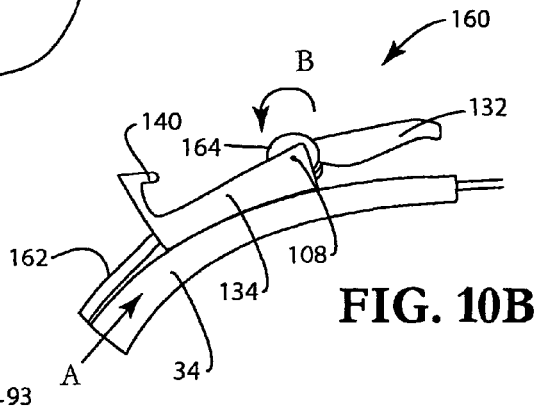
FIG. 10B is an expanded view of cam of FIG. 10*a* in an open configuration.
Figure 10D:
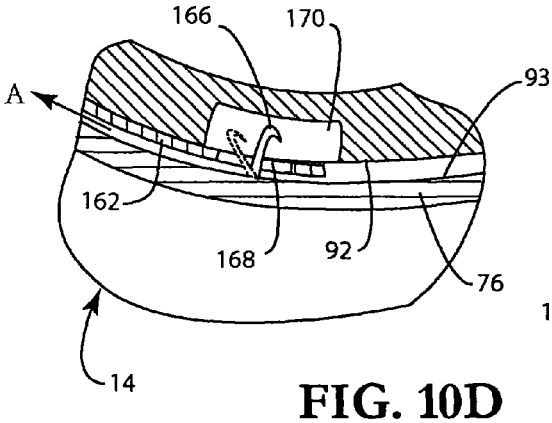
FIG. 10D is an expanded cross-sectional view of the interface shown in FIG. 10*a*.
Figure 10C:
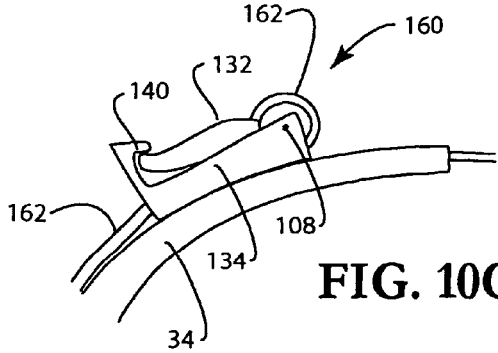
FIG. 10C is an expanded view of cam of FIG. 10*a* in a closed configuration.

Now referring to FIGS. 10A-C, an alternative embodiment using a tension belt as a releasable connection is illustrated. A cam buckle assembly 160, illustrated in an open configuration in FIGS. 10A and 10B, comprises a lever arm 132 coupled to a mandrel 160 that is rotatably connected to bracket 134 at hinge 108. Preferably a left and right cam buckle assembly 160 are positioned on the front end of hip belt 34,40 so that both sides of the movable compartment are equally secured to the harness. Tension belt 162 is attached at a first end to the bottom side of mandrel 164, and a second end of the tension belt is follows the outside contour of the hip belt 34,40 to the front wall 92 of the harness panel 22. Tension belt 162 may be retained to the outside surface of the hip belt by loops, or alternatively underneath a sheet of fabric (not shown) that is sewn to the hip belt 34, 40 to create a channel for the tension belt. The second end of the tension belt 162, while being retained to the outer contour of the hip belt, is free to advance or slide along the hip belt in direction A as shown in FIG. 10B. The second end of tension belt 162 has slot 168 that is adjacent recess 170 in the front wall 92 support panel 22. The back surface 93 of movable compartment 14 has a tension catch 166 that is aligned with slot 168 tension belt 162 and recess 170 such that the catch 166 freely advances through slot 168 and into recess 170 when the movable compartment 14 is placed adjacent to the harness in its stowed position.

To secure the movable compartment, both lever arms of cam buckles 160 are rotated in direction B toward locking tab 140 of bracket 134 as illustrated in FIG. 10C, such that tension belt 162 is wrapped around mandrel 164, advancing the free end of tension belt 162 along the hip belt in direction A. As tension belt 162 advances, slot 168 hooks on to catch 166. Catch 166 may be semi-flexibly attached to the stiffening panel 76 of the movable compartment such that a tensile force is created as the catch 166 deforms (illustrated as phantom lines in FIG. 10D). Tensile force from the tension belt 162 secures the movable compartment to the harness panel to retain it from shifting or sliding during motion or impact.

In another alternative backpack 175 illustrated in FIGS. 11 and 12, movable compartment 15 is connected to the shoulder pads of harness 12 by rotation straps 100. The rotation straps are connected at one end to the top of the movable compartment 14 with reinforcement material 174. At the other end, rotation straps are looped around fastening loops 60 and retained by stitching, a fastener or the like. Hook and loop material 172 may also be provided between the rotation strap 100 and the top section 30 of the support panel 22 or shoulder pad to provide further stability against lateral movement of the movable compartment with respect to the harness.

Referring now to FIG. 12, movable compartment 15 may be moved from its stowed position (shown as phantom lines 180) by releasing releasable connection 36 at the hip belt. The wearer can then advance the movable compartment 14 to a frontal position (shown as phantom lines 182) by pulling on compression strap 64 or grasping handle 70 and pulling the movable compartment over the wearer's shoulders and head about the fastening loops 60. The rotation straps 100 (or U-shaped section of the main compartment shown in FIG. 1) are sized to provide clearance for the movable compartment 15 over the wearer's head as it is rotated to and from the stowed position 180 to frontal position 182. With the movable compartment in the frontal position 182, the articles inside of the compartment can readily be accessed without having to remove the backpack.

Referring to FIG. 11, the harness panel 22 may also have a recess 176 for carrying a hydration bladder (not shown) or the like. In such a configuration, access port 178 may be located at the top of the harness panel 22 so that a hydration tube (not shown) coupled to the bladder may be directed toward the front of the user. Storing the hydration bladder in a separate compartment such as the support panel 22 has several benefits, including separating the bladder from bulky gear that can damage the bladder, avoiding possible interruption of fluid delivery, and allowing the maximum capacity for storage in the movable compartment the can be limited with a full bladder.

Still referring to FIG. 11, the support strap 62 and compression strap 64 may be oriented downward by angle $\phi$. Angle $\phi$ may generally range from 5-45 degrees to create a vertical tensile load as well as a lateral load when the compression strap is tightened. Thus the movable compartment 15 is restrained from rotation and translation outward and laterally from harness 12, in addition to rotation and movement upward in relation to the harness. It will be appreciated that the movable compartment 14 shown in FIG. 1 may also be restrained laterally and vertically by orienting support strap 62 at angle $\phi$.

Now referring to FIG. 13 (showing the harness panel with the movable compartment removed), the front wall 92 of support panel 22 may optionally have mounting straps 196, 202 for securing large equipment to the pack between the harness and the movable compartment. For example, a snowboard 208 may be secured to the harness 22 by tightening the ends 198 of the mounting straps 196 within loops 210. In addition, a pair of skis 206 may be attached to the harness 22 with straps 202. Recesses 192, 194 may be provided in the support panel so that the mounting straps and loops do not protrude from the front wall 92 of the support panel. Front wall 92 may also have a pocket 197 sewn to the front wall 92 on three sides to form an opening 195. The pocket 197 may be used to retain additional gear such as a shovel (not shown), wherein the blade of the shovel is retained in the pocket 197, and handle is retained by either or both of straps 202. It would be understood to one skilled in the art that the mounting straps could be sized and oriented in a number of configurations, e.g. horizontal, vertical, or diagonal. Additional mounting straps may be disposed on the exterior surface of the movable compartment to interchangeably attach the above gear to a plurality of different possible locations.

Figure 14:
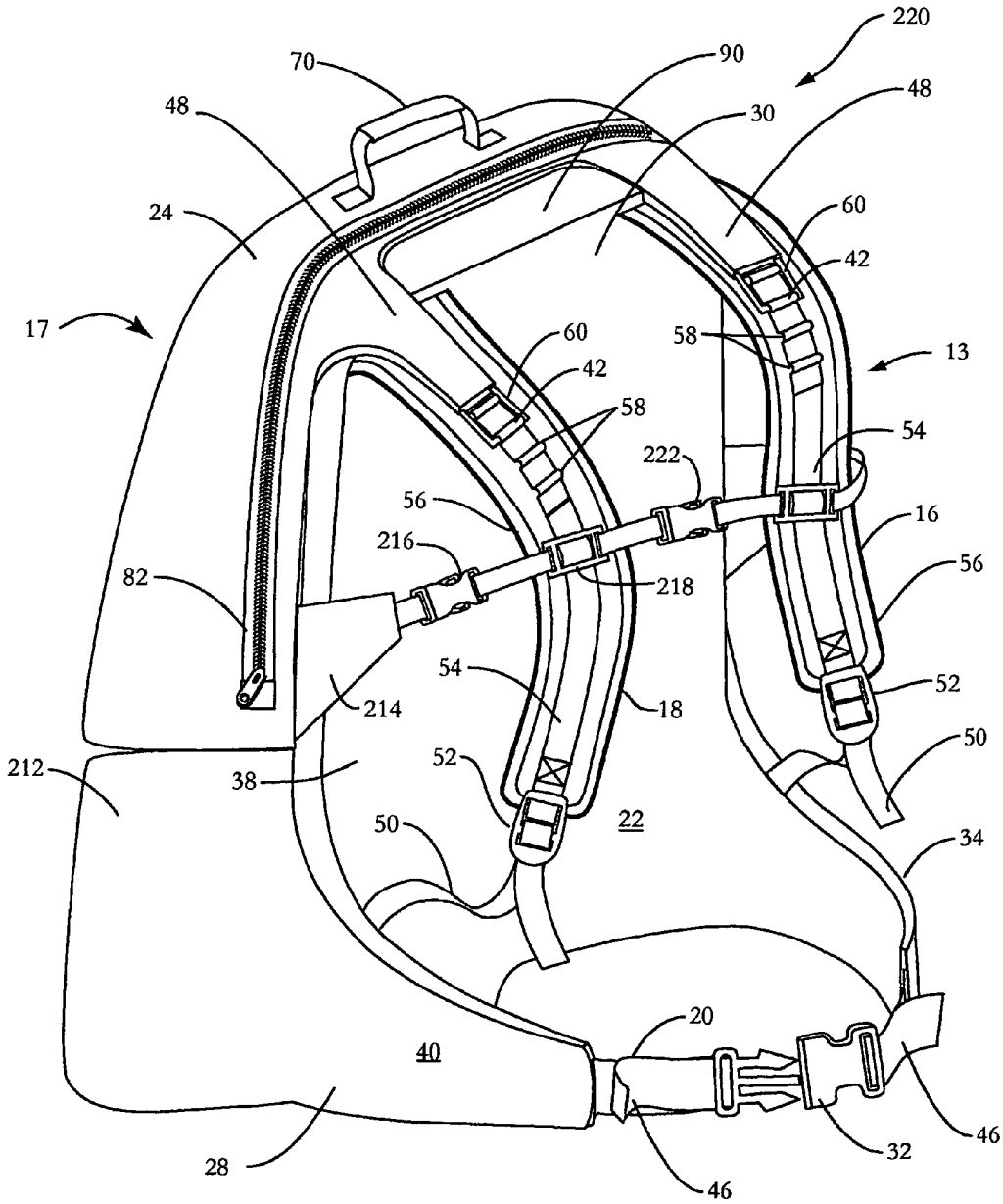
FIG. 14 illustrates yet another embodiment of the invention wherein the movable compartment comprises an upper of two storage compartments.

FIG. 14 illustrates an alternative embodiment of the invention wherein the backpack 220 comprises a movable compartment 17, which is the upper of two movable compartments. The lower movable compartment 212 is attached or integrated with the lower section 28 of the harness panel 22. The movable compartment 17 is attached to a frontal position on the left and right shoulder straps 18 and 16 via support straps 214 and releasable connections 216. Releasable connections 216 may comprise quick release buckles as shown in FIG. 14, or any other connector known in the art or described in the embodiments disclosed above. To keep the shoulder straps from moving outward from the center of the torso, sternum strap 222 laterally connects the left and right shoulder straps together via sliders 218 slidably attached to the mounting straps 54. The upper section 24 of movable compartment is attached via pivotable connections 42 to the upper section 30 of the harness 13 such as the left and right shoulder straps 16, 18. In this configuration, movable compartment 17 may be rotated to the front of the user upon release of releasable connections 216, while the lower compartment 212 remains at the back of the user. Lower compartment may be configured with openings (not shown) and capacity to store items that are not as frequently accessed as those placed in the movable compartment 17.

Figure 15:
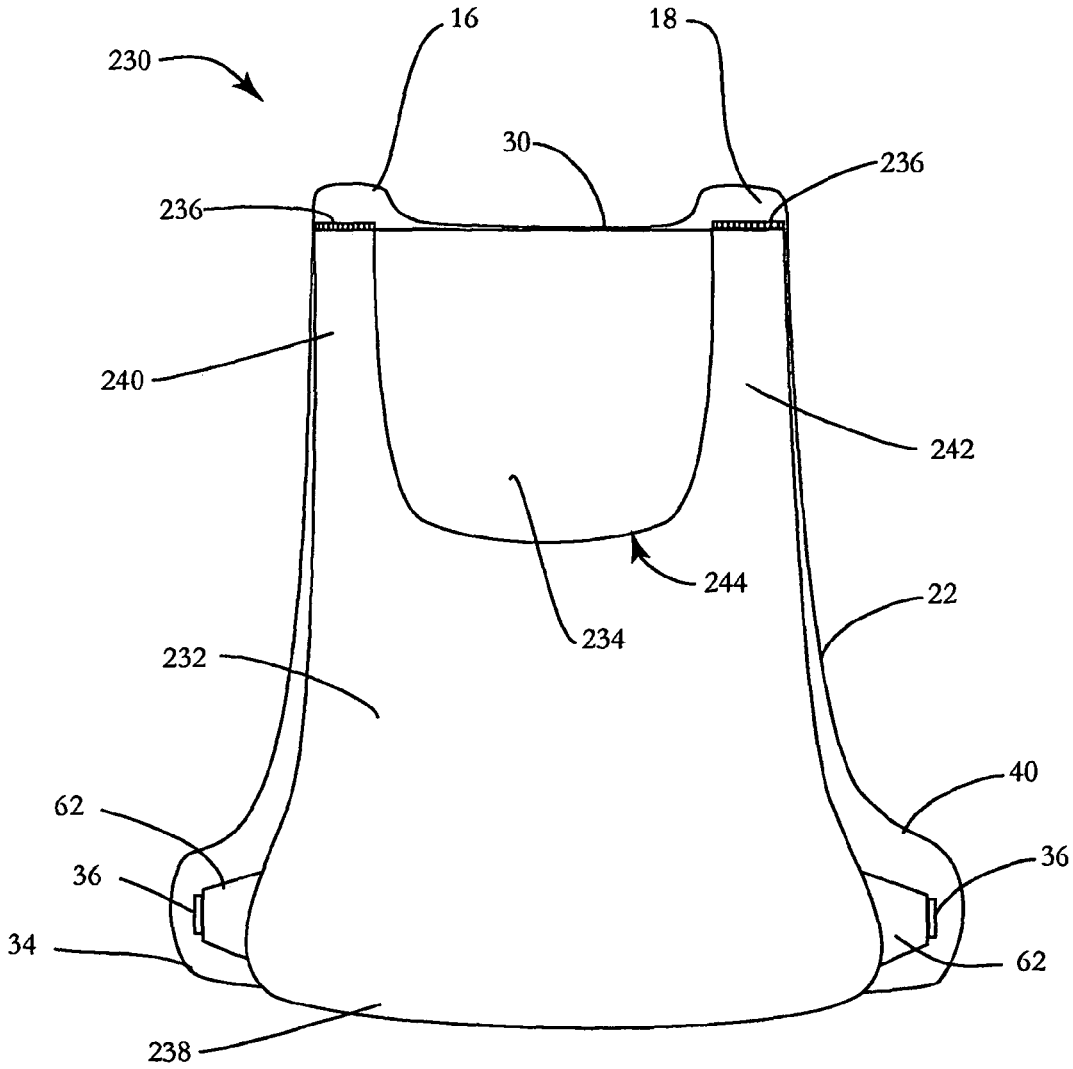
FIG. 15 is a rear view of another embodiment of the invention wherein the movable compartment is the lower of two storage compartments.

Now referring to FIG. 15, yet another embodiment of the invention is illustrated showing a rear view of backpack 230. Backpack 230 has a movable compartment 232 that left and right arms 240, 242 at its upper end. Left and right arms 240 and 242 form a U-shaped recess 244 to allow clearance for the movable compartment 232 when being rotated to the front of the user. A fixed upper compartment 234 may be fastened to the support panel 22 and have a shape matching that of recess 244 so that the movable compartment 232 is restrained from lateral motion while fastened in the stowed position as shown in FIG. 15.

The movable compartment 232 is pivotably connected at its upper arms 240, 242 to the upper end 30 of the harness support panel 22 (or shoulder straps 16,18) by pivotable connections 236. Movable compartment 232 is releasably fastened at its lower end 238 to the left and right padded sections 34, 40 of the hip belt via support straps 62 and releasable connections 36. Upper compartment 234 may have openings (not shown) to allow articles to be stored in the compartment that generally don't need to be accessed as frequently as articles in the movable compartment. Movable compartment 232 may be unfastened from releasable connection 36 to allow the movable compartment to be rotated over the head of the user to the front of the user. When worn on a ski lift, upper compartment 234 will be generally high enough on the back of the user to be above the ski lift back rest so as not to interfere with the backrest. In an alternative embodiment (not shown) the upper compartment 234 may be detachable from the support panel 22 to allow for mounting of gear, or support panel 22 may be flat at the area adjacent to recess 244, without an additional compartment.

Figure 16:
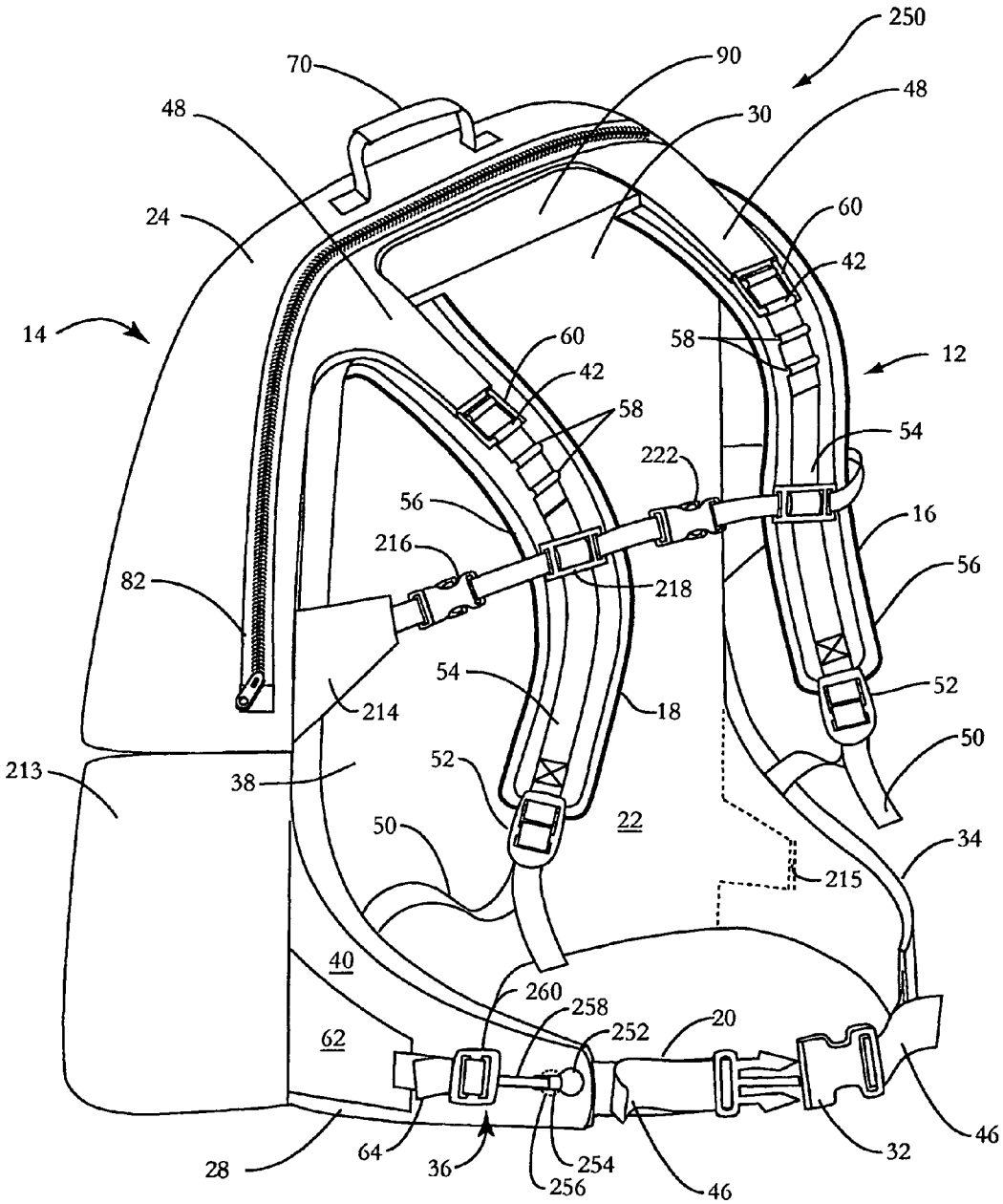
FIG. 16 shows a perspective view of an embodiment of the invention having a lower movable compartment that rotates laterally about the hip of the user.

In an alternative embodiment shown in FIG. 16, backpack 250 has a lower movable compartment 213 that is pivotably connected at 215 on the left waist belt pad 34, and releasably connected to the right waist belt pad 40. The pivotable connection 215 may also be located at the left edge of the support panel 22 of the harness 12. Thus, when the releasable side is disconnected, the lower compartment 213 may be swung around the hip about the rotatable connection to the front of the user. The upper compartment 19 may be rotatably/releasably connected as shown in FIG. 16, or fixed to the harness by stitching (not shown).

Releasable connection 36 may comprise an interlocking connector 260 having a T-shaped arm 258 with an oval-shaped tip 256 such that the arm 258 may be inserted into circular slot 252 embedded into hip pad 40. The connector 260 may then be slid toward down the narrow end 254 of the slot to engage the connector with the hip pad. Compression strap 64 may then be tightened to secure the lower end movable compartment 212 to the harness. Interlocking connector 260 and slot 252 may be used to releasably secure movable compartment 10 shown in any of FIGS. 1A, 1B or 11.

Figure 17:
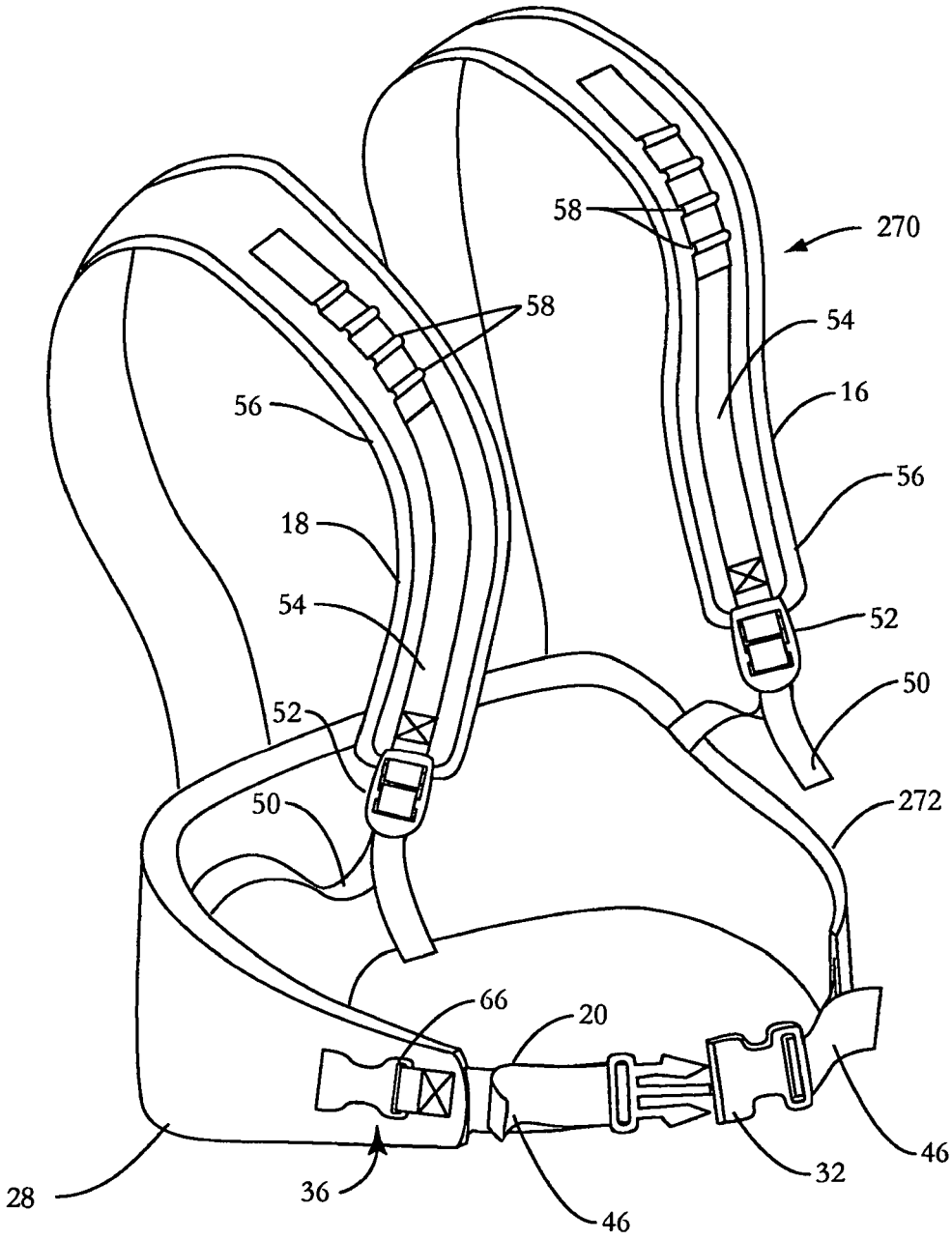
FIG. 17 illustrates a harness of the present invention without a support panel.

Now referring to FIG. 17, the harness 270 may comprise left and right shoulder straps 16, 18 that directly attach at their ends to hip belt 272. A chest strap (not shown) similar to that of the embodiment shown in FIG. 16 may also be used to prevent the shoulder straps from separating laterally from the user's chest. This configuration of harness 270 minimizes weight while still providing a platform to mount the pivotal and releasable connections.

Figure 18:
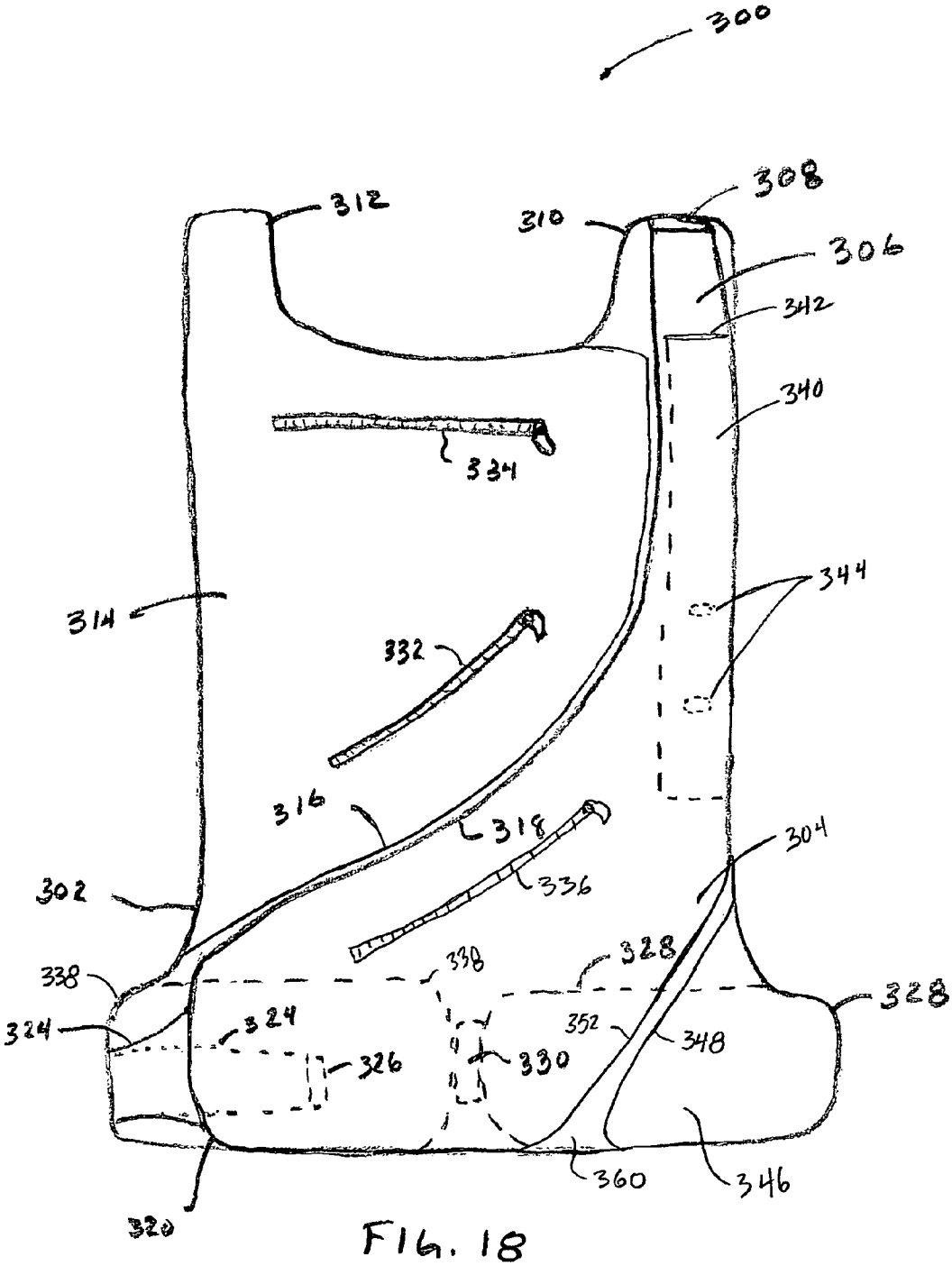
FIG. 18 illustrates an alternative backpack having only one pivotable connection at or near a shoulder strap, and one releasable connection on a hip belt opposite the shoulder strap.

FIG. 18 illustrates an additional embodiment of the present invention incorporating a one-hinge configuration 300. In backpack 300, a moveable compartment 304 is shown in a stowed configuration attached to harness 302 via a hinge 308 positioned on the right shoulder strap 310 of the harness 302. It is appreciated that the attachment of pivotable connection or hinge 308 may also be below the shoulder strap at a location near the shoulder strap. The harness 302 comprises left and right shoulder straps 312, 310, and left and right hip belts for coupling the backpack 300 to the user's torso, and a stationary or fixed compartment 314 that is above and to the left of moveable compartment 304.

The moveable compartment 304 is attached to pivotable connection 308 (which may comprise any pivotable connection described in the various embodiments above) via a arm 306 that may be integral with compartment 304, or a separate strap (see strap 100 in FIG. 11). The left-most extent of the moveable compartment is attached to a frontal position on the left hip belt 338 via a releasable connection 326, which may comprise any releasable connection described in the various embodiments above. Strap 324 may be used to couple the left end 320 of the moveable compartment to releasable connection 326, or the compartment 304 may be integral with the releasable connection 326 such that the left end extends to connection 326.

As shown in FIG. 18, the moveable compartment generally extends diagonally down from connection 308 across the harness 302 toward the hip of the user on the opposing side of the body (e.g. under the opposite shoulder of the shoulder where the pivotable connection is located).

The fixed compartment 314 has a lower extent 316 that generally follows, or abuts to, the upper extent 318 of the moveable compartment when in the stowed position. Thus, the moveable compartment may be tightened, e.g. via an adjustable buckle (see buckle 68 in FIG. 11) at connection 326 so that upper extent 18 abuts to lower extent 316. The lower extent 316 may have sufficient rigidity to impede further upward and leftward motion of moveable compartment 304 beyond the outline of 316, thus stabilizing the moveable compartment 304 from motion with respect to harness 302.

The left-lower extent 320 of the moveable compartment 304 is configured to be released at releasable connection 326 so that moveable compartment (e.g. by pulling arm 324 over head), may be pivoted about connection 308, and over/to the right side of user's head to bring the moveable compartment 304 to the front of the torso for access.

While the moveable compartment 304 is shown in FIG. 18 as a generally crescent J-shaped compartment extending from the right shoulder strap 310 to the left hip belt 338, it is appreciated that the moveable compartment 304 and fixed compartment 314 may be a mirror image of the configuration shown in FIG. 18, such that the moveable compartment 304 is shown is a generally crescent L-shaped compartment extending from the left shoulder strap 312 to the right hip belt 328, with the stationary department 314 on the right side of the pack.

Stationary compartment 314 and moveable compartment 304 may have several openings 332, 334, 336 for access to the pockets therein. In addition, arm 306 may have an elongate pocket 340 that extends to opening 342, the pocket 340 for holding elongate items (e.g. bike pump, etc.). The pocket 340 may also include snaps, buttons 344, or the like releasable connection for expanding or minimizing the length of the pocket 340 to match the length of the elongate article (not shown).

A second fixed compartment 346 may also be included to have an upper extent 348 that matches or abuts to the lower extent 352 of the moveable compartment 352. This creates a channel 360 diagonally positioned along the harness 302 to allow the moveable compartment 304 to rest in the harness, and thereby provide additional security for moveable compartment 304.

Figure 19:
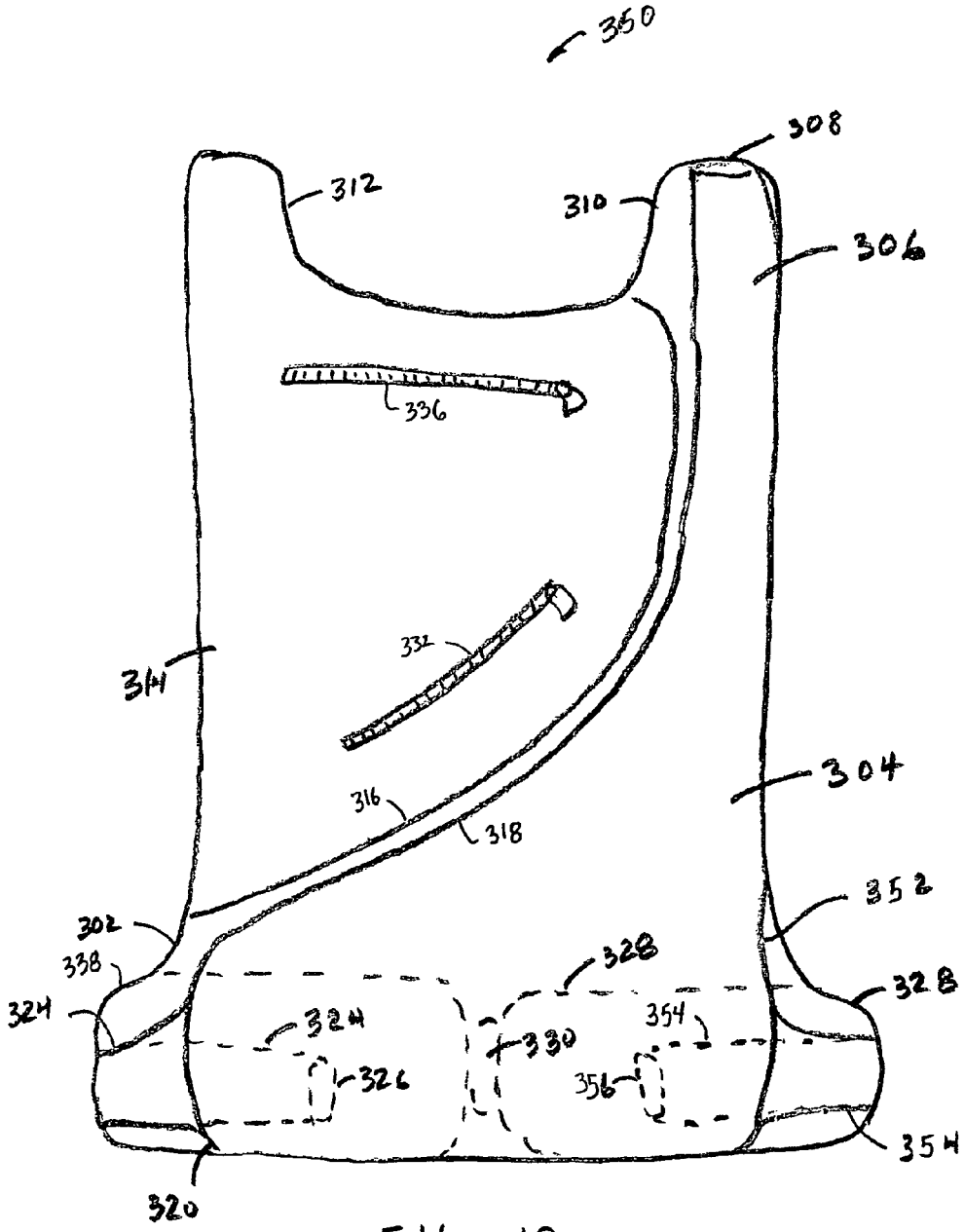
FIG. 19 illustrates an alternative backpack having only one pivotable connection at or near a shoulder strap, and two releasable connections at or near the hip belt.

FIG. 19 illustrates an additional embodiment of a one-hinge backpack 350 that has a single pivotable attachment 308 and dual releasable connections 326 and 356 to left hip belt 338 and right hip belt 328 respectively. The right-lower extent 352 of the moveable compartment 304 may integrally connect to releasable connection 356 (not shown), or be coupled to releasable connection 356 via support strap 354. It is appreciated this configuration may alternatively comprise a left shoulder strap 312 mounted pivotable connection 308 and crescent L shape, as detailed above.

It is further appreciated that the arms/straps 324, 354 may be extended so that the releasable connections 326, 356 connect to each other (e.g. like a male and female end of a buckle), and thus do not attach to the hip belt 328, 338, but rather extend around the waist and connect either above hip belt connection 330, or to the left or right of it. It is further appreciated that such a connection may be used in any of the various embodiments disclosed above.

Although the description above contains many details, these should not be construed as limiting the scope of the invention but as merely providing illustrations of some of the presently preferred embodiments of this invention. For example, it will also be appreciated that any of the releasable connections, pivotable connections, adjustment or tightening means, harness panels, movable compartments, stiffening means, chest strap herein described may be interchangeably configured where practical to form a number of combinations and configurations not explicitly described or illustrated in the above description. It will further be appreciated that although the particular embodiments described herein may be particularly useful for skiing and snowboarding, the backpack of the present invention may be modified, without departing from the general principles herein described, in size and shape to more particularly pertain to any one of a number of outdoor activities, e.g. backpacking or cycling. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A backpack comprising:

a harness configured to securely attach to a user's torso;

a movable storage compartment having a first portion and a second portion, a pivotable connection pivotally connecting the first portion of the movable compartment to a first location on the harness to allow reorientation of the movable compartment from a stowed position to a frontal position on the user;

a releasable connection releasably connecting the second portion of the movable compartment to a second location on the harness;

wherein motion of the movable compartment with respect to the harness is substantially locked in the stowed position when the releasable connection is engaged;

wherein the releasable connection is configured to disengage so that the movable compartment may be reoriented from the stowed position to a frontal position on the user;

wherein the harness comprises:

a waist belt;

left shoulder strap;

right shoulder strap; and a support panel;

the support panel having a back wall configured to be worn adjacent to the user's back and a front wall adjacent to the movable compartment when the compartment is in the stowed position;

the support panel further having an upper section attached to a first end of each of the left and right shoulder straps and a lower section attached to a second end of the left and right shoulder straps;

wherein the waist belt comprises first and second arms affixed to the lower section of the support panel;

wherein the first portion of the movable compartment is located at an upper section of the movable compartment, and the second portion of the movable compartment is located at a lower section of the movable compartment; and wherein the first portion of the movable compartment is pivotably connected via a pivotable connection at or near one of the left or right shoulder straps, and the second portion of the movable compartment is releasably secured in the stowed position around at least a portion of the waist of the user at a location accessible to the user while wearing the backpack;

wherein the pivotable connection comprises a singular connection at or near one of the left or right shoulder straps; and wherein second portion of the moveable compartment is releasably secured, while the moveable compartment is in the stowed position on the user, at a first releasable connection at a first frontal location on the first arm of the waist belt, the first arm being opposite from the singular pivotable connection, the frontal location comprising an anterior side of the torso while the user is wearing the backpack with the waist belt secured around the torso.

2. A backpack as in claim 1, wherein the pivotable connection comprises a singular connection at or near one of the left or right shoulder straps; and wherein second end of the moveable compartment is releasably secured around the waist of the user.

3. A backpack as in claim 1, wherein the second end of the moveable compartment is releasably secured at a second releasable connection at a second frontal location on the second arm of the waist belt;

wherein the first and second frontal locations of the releasable connections are located at an anterior side of the torso while the user is wearing the backpack with the waist belt secured around the torso and substantially spaced apart from the moveable compartment when the moveable compartment is positioned in the stowed position.

4. A backpack as in claim 1, wherein the moveable compartment, in a stowed configuration, has an upper extent that extends from the pivotable connection and diagonally downward from the pivotable connection and across the harness to one of the first and second waist belt arms that are on the opposing side of the harness from the pivotable connection.

5. A backpack as in claim 4, the pivotable connection being at or near a first shoulder of the user when the backpack is positioned on the body; and wherein the moveable compartment has an upper extent that extends, when the moveable compartment is in the stowed position on the user's body, diagonally across the torso of the user and under an opposing shoulder of the user to releasably connect on a frontal position on the waist belt.

6. A backpack as in claim 5, further comprising:

a second compartment protruding outward from the harness and having a lower extent extending diagonally above the moveable compartment when the moveable compartment is in the stowed position;

wherein the second compartment has a lower extent that substantially matches at least a portion of a profile of the upper extent of the moveable compartment.

7. A backpack as in claim 6, wherein the second compartment is configured to be fixed to the harness such that the lower extent of the second compartment restrains upward motion of the upper extent of the moveable compartment with the moveable compartment is in the stowed configuration.

8. A backpack as in claim 6:

wherein lower extent of the second compartment comprises a convex path; and wherein upper extent of the moveable compartment comprises a concave path.

9. A backpack as in claim 8, wherein the concave path and convex path are curvilinear.

10. A backpack as in claim 7:

wherein the first releasable connection is adjustable to tighten the upper extent of the moveable compartment against the lower extent of the second compartment.

11. A backpack comprising:

a harness configured to securely attach to a user's torso;

a movable storage compartment having a first portion and a second portion, a pivotable connection pivotally connecting the first portion of the movable compartment to a first location on the harness to allow reorientation of the movable compartment from a stowed position to a frontal position on the user;

a releasable connection releasably connecting the second portion of the movable compartment to a second location on the harness;

wherein motion of the movable compartment with respect to the harness is substantially locked in the stowed position when the releasable connection is engaged;

wherein the releasable connection is configured to disengage so that the movable compartment may be reoriented from the stowed position to a frontal position on the user;

wherein the harness comprises:

a waist belt;

left shoulder strap;

right shoulder strap; and a support panel;

the support panel having a back wall configured to be worn adjacent to the user's back and a front wall adjacent to the movable compartment when the compartment is in the stowed position;

the support panel further having an upper section attached to a first end of each of the left and right shoulder straps and a lower section attached to a second end of the left and right shoulder straps;

wherein the waist belt comprises first and second arms affixed to the lower section of the support panel;

wherein the first portion of the movable compartment is located at an upper section of the movable compartment, and the second portion of the movable compartment is located at a lower section of the movable compartment; and wherein the first portion of the movable compartment is pivotably connected via a pivotable connection at or near one of the left or right shoulder straps, and the second portion of the movable compartment is releasably secured in the stowed position around at least a portion of the anterior waist of the user at an anterior location accessible to the user while wearing the backpack; and wherein the pivotable connection comprises a singular connection at or near one of the left or right shoulder straps.

12. A backpack as in claim 11, wherein second end of the moveable compartment is releasably secured, while the moveable compartment is in the stowed position on the user, at a first releasable connection at a first frontal location on the first arm of the waist belt, the first arm being opposite from the singular pivotable connection, the frontal location comprising an anterior side of the torso while the user is wearing the backpack with the waist belt secured around the torso.

13. A backpack as in claim 12, wherein the moveable compartment, in a stowed configuration, has an upper extent that extends from the pivotable connection and diagonally downward from the pivotable connection and across the harness to one of the first and second waist belt arms that are on the opposing side of the harness from the pivotable connection.

14. A backpack as in claim 13, the pivotable connection being at or near a first shoulder of the user when the backpack is positioned on the body; and wherein the moveable compartment has an upper extent that extends, when the moveable compartment is in the stowed position on the user's body, diagonally across the torso of the user and under an opposing shoulder of the user to releasably connect on a frontal position on the waist belt.

15. A backpack as in claim 11, further comprising:

a second compartment protruding outward from the harness and having a lower extent extending diagonally above the moveable compartment when the moveable compartment is in the stowed position;

wherein the second compartment has a lower extent that substantially matches at least a portion of a profile of the upper extent of the moveable compartment.

16. A backpack as in claim 6, wherein the second compartment is configured to be fixed to the harness such that the lower extent of the second compartment restrains upward motion of the upper extent of the moveable compartment with the moveable compartment is in the stowed configuration.

17. A backpack as in claim 6:

wherein lower extent of the second compartment comprises a convex path; and wherein upper extent of the moveable compartment comprises a concave path.

18. A backpack as in claim 7:

wherein the moveable compartment is adjustably secured to the harness allow the upper extent of the moveable compartment to be tightened against the lower extent of the second compartment.

19. A backpack comprising:

a harness configured to securely attach to a user's torso;

a movable storage compartment having an upper section and a lower section, a pivotable connection pivotally connecting the upper section of the movable compartment to a first location on the harness to allow reorientation of the movable compartment from a stowed position located at a posterior side of the torso to a frontal position on the user located at an anterior side of the torso;

a releasable connection releasably connecting the lower section of the movable compartment to a second location on the harness;

wherein motion of the movable compartment with respect to the harness is substantially locked in the stowed position when the releasable connection is engaged;

wherein the releasable connection is configured to disengage so that the movable compartment may be reoriented from the stowed position to a frontal position on the user;

wherein the lower section of the movable compartment is releasably secured in the stowed position around at least a portion of the anterior waist of the user at an anterior location accessible to the user while wearing the backpack;

wherein the pivotable connection comprises first and second pivotable connections, the first and second connections being laterally spaced apart at an upper section of the harness;

wherein the upper section of the movable compartment has a recess extending downward from and spanning contiguously in between the first and second pivotable connections to provide clearance for the movable compartment as it is rotated over the user's head from the stowed position to the frontal position on the user.

20. A backpack as recited in claim 19, wherein the harness comprises:

a waist belt;

left shoulder strap;

right shoulder strap; and a support panel;

the support panel having a back wall configured to be worn adjacent to the user's back and a front wall adjacent to the movable compartment when the compartment is in the stowed position;

the support panel further having an upper section attached to a first end of each of the left and right shoulder straps and a lower section attached to a second end of the left and right shoulder straps;

wherein the waist belt comprises first and second arms affixed to the lower section of the support panel.

* * * * *